US005456555A

United States Patent [19]

Bökeler

[11] Patent Number: 5,456,555

[45] Date of Patent: Oct. 10, 1995

[54] STRUCTURAL SET OF ANGLE ELEMENTS FITTING INTO ONE ANOTHER

[76] Inventor: Hans-Jörg Bökeler, Scheibbser Str. 46, D-7255 Rutesheim, Germany

[21] Appl. No.: 108,428

[22] Filed: Aug. 19, 1993

Related U.S. Application Data

[63] Continuation of Ser. No. 973,708, Nov. 9, 1992, abandoned.

[30] Foreign Application Priority Data

Feb. 22, 1990 [WO] WIPO ..... PCT/DE89/00505

[51] Int. Cl.[6] ..... E02D 29/02

[52] U.S. Cl. ..... 405/286; 52/562; 405/285

[58] Field of Search ..... 52/593, 594, 610, 52/609, 562; 405/284, 286 OR, 287, 285

[56] References Cited

U.S. PATENT DOCUMENTS

| | | | |
|---|---|---|---|
| 3,269,125 | 8/1966 | Moore | 52/594 |
| 3,444,694 | 5/1969 | Frehner | 405/286 |
| 4,099,386 | 7/1978 | Sagasta | 405/286 |
| 4,521,138 | 6/1985 | Steiner | 405/286 |
| 4,671,706 | 6/1987 | Giardini | 405/286 |
| 4,798,499 | 1/1989 | Yamada | 405/286 |
| 4,825,619 | 5/1989 | Forsberg | 52/562 |

FOREIGN PATENT DOCUMENTS

| | | | |
|---|---|---|---|
| 7614681 | 10/1976 | Germany . | |
| 2737322 | 2/1978 | Germany . | |
| 8223515 | 9/1982 | Germany . | |
| 3233014 | 3/1984 | Germany . | |
| 3501148 | 7/1986 | Germany | 405/285 |

*Primary Examiner*—Carl D. Friedman
*Assistant Examiner*—Wynn E. Wood
*Attorney, Agent, or Firm*—Antonelli, Terry, Stout & Kraus

[57] ABSTRACT

Set of angular building elements for building visual protection, acoustic protection or detonation protection walls which can contain plants, for plant tubs, slope supporting elements, supporting pillars as well as surrounds for plots, paths and flower-beds. Molded bricks and elements, having a mainly equal-sided angular cross-section with any internal angle, mainly of 90 and 60 degrees, and equal-sided side ends, are assembled by masonry techniques with offset cross-joints into free-standing or escarped supports and walls with plants. Various walls and supports which can be statically load-bearing can thus be constructed without liquid by means of a single angular element and the hollow chambers can be reinforced and grouted with mortar. Several solutions are available for dowelling the horizontal joints, such as edge molding and connecting pins. Moreover, said building elements can be of various materials of corresponding dimensions, for example concrete for building constructions systems, timber for furniture and partition walls, or synthetic materials for models.

5 Claims, 13 Drawing Sheets

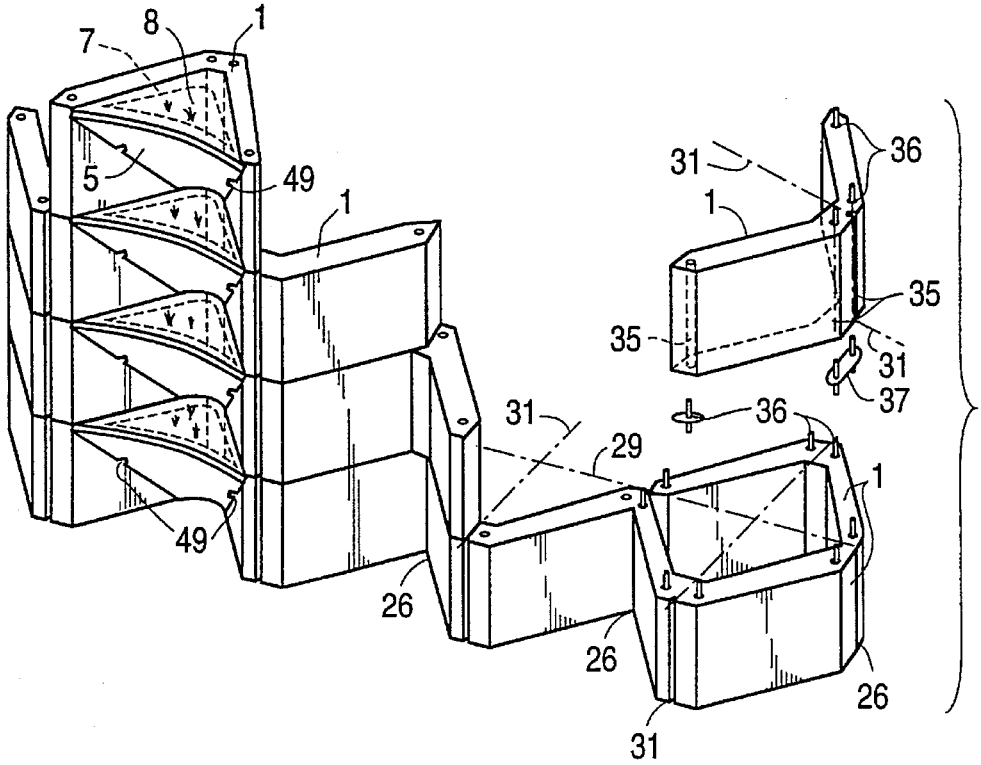
FIG. 1e
FIG. 1f
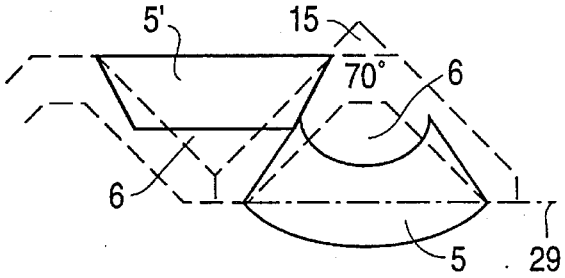

FIG. 2a
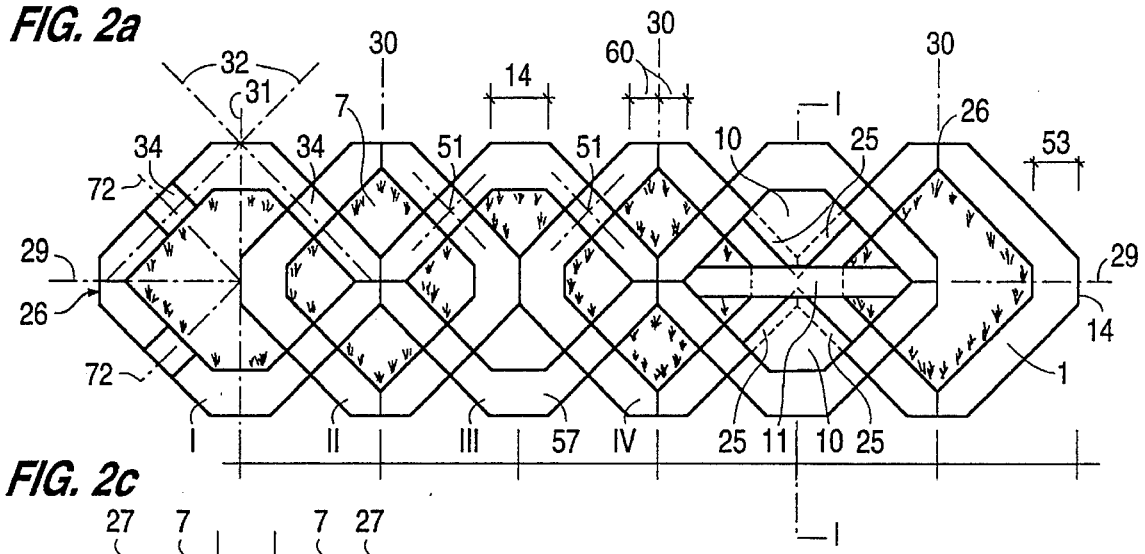
FIG. 2c
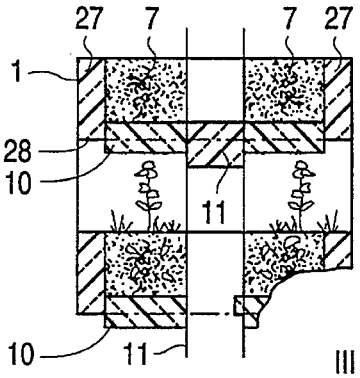
FIG. 2b
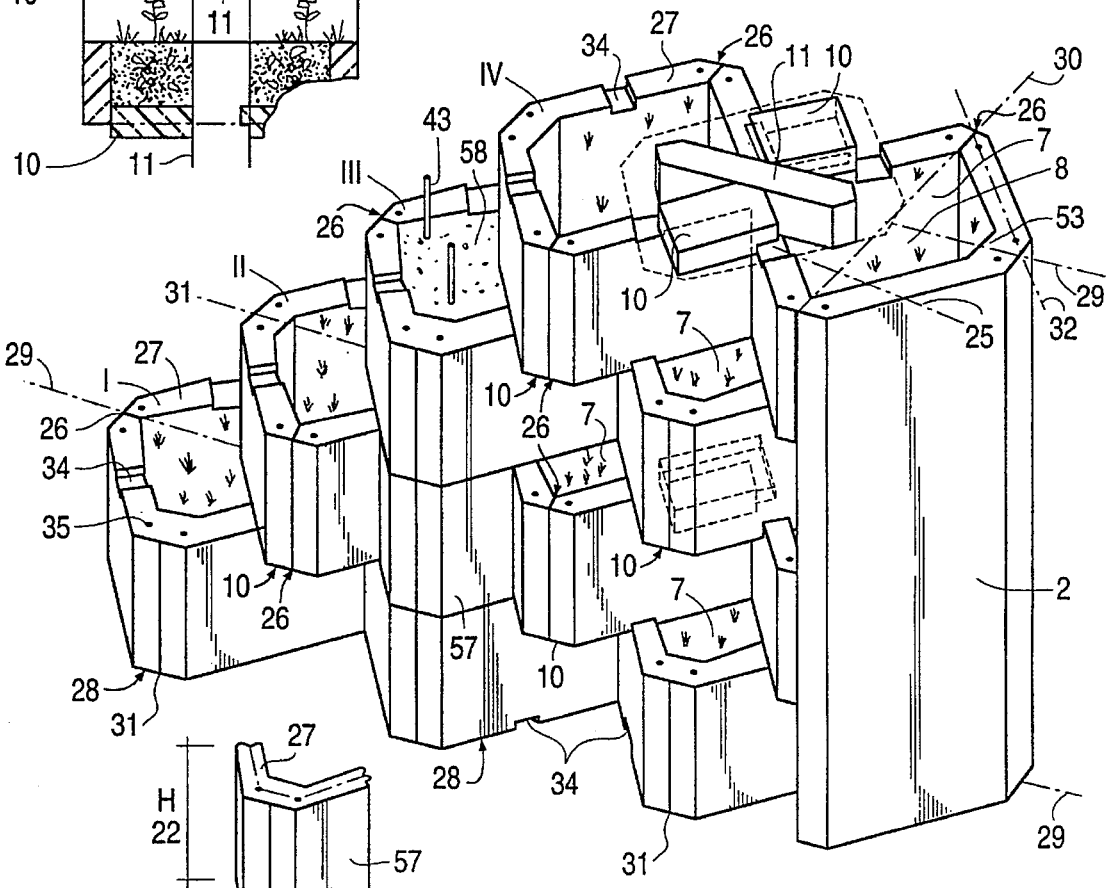
FIG. 2d

N
E
W
104

STRUCTURAL SET OF ANGLE ELEMENTS FITTING INTO ONE ANOTHER

This is a continuation of application Ser. No. 973,708 filed Nov. 9, 1992, now abandoned.

SPECIFICATION

The invention relates to a structural set of angle elements fitting into one another, for the erection of plantable visual protection and acoustic protection walls, slope stabilizations, and supports, as well as surrounds for real estate, paths, and flower beds, prefabricated buildings, and toys, in accordance with the features determining the type involved as recited in

PRIOR ART

Molded concrete blocks of an angular contour are widely known, popular in commerce under the name of "L blocks" or angle bricks. These L blocks exhibit parallel transverse rims and, respectively, cover and bottom surfaces, a rectangular, equal-sided contour with a side length of respectively about 40 cm, a height of about 40 cm, a thickness of material of about 6–10 cm, and a weight of about 51 kg. Their leg ends extend at an obtuse angle of 90° with respect to the leg edges. They have smooth outer surfaces and serve, above all, landscape gardeners and do-it-yourself builders for designing and enclosing elevated planted patches, sand-boxes, terraces, and similar structures.

One disadvantage of the conventional L block is, above all, its obtuse-angled design of the leg ends rendering the L block unsuitable for joining with parallel contact surfaces in the longitudinal and transverse directions and for laying bricks in bond fashion. Thereby, its use possibilities are restricted and permit utilization in most cases solely in the horizontal position, i.e. with a transverse rim in parallel to the ground. Its relatively high weight of 51 kg and its design of smooth, not textured concrete, which is not very satisfactory from the viewpoint of construction and design, limit its utilization possibilities.

The conventional L blocks cannot be doweled or intermeshed at their butt joints. They are seated on top of and beside one another, respectively, merely held by gravity and material-induced friction, with vertically superimposed butt joints. Laying with staggered butt joints or formation of supports and pillars is impossible. Also, vertical earth columns and tiered plant pockets cannot be built up. Furthermore, under G 82 23 515, a concrete ring has been known with four walls curved alternatingly toward the outside and toward the inside wherein respectively two mutually opposed sides are fashioned to be convex and concave. This molded brick can be laid into freestanding and unilaterally escarped walls, by laying the bricks in side-by-side and superimposed rows. The drawback with respect to this hollow brick which is laterally closed, and open at the bottom and at the top, resides in its large external dimension, with the effect of an expensive empty space as regards production, storage, and transportation. Besides, its utilization is limited exclusively to walls and escarpments.

Other trough-shaped scarping bricks with similar disadvantages as in G 82 23 515 are known under GM 76 14 681 and 32 33 014. Reference 32 33 014 shows a hollow brick as a regular, closed octagon with a planar underside and with top-positioned cutouts at every second polygon side. They permit interlocking of superimposed layers, but only with a stepwise placing mode for unilateral slope pavings. These trough-like blocks are not suitable for freestanding, plantable walls.

OBJECTIVES

Accordingly, the invention is based on the object of fashioning a structural set of angle elements of the type discussed hereinabove in such a way that the aforementioned disadvantages of the known molded bricks are avoided. Instead, it is to be possible, with a minimum of component parts of the system which are adapted to one another, to realize variegated solutions in an economical, ecological, and esthetically valuable way.

The shape of the angle brick, favorable from static and economical viewpoints, is to be made useful universally for the construction of walls. Its stackability is to be made use of as an advantage as regards weight and costs in production, storage, transportation, and assembly.

The angle blocks are to be shaped at the joint so that identical blocks, in abutting relationship, can be endlessly extended to freestanding and/or unilateral planted walls. In a composite with staggered butt joints and doweled horizontal joints, the angle bricks are to be layable into walls and supports of high stability and rigidity even in the dry state, i.e. without mortar. Vertical wall surfaces are to be made plantable and ecologically usable. It is to be possible to enhance noise damping by earth fillings and plantability.

The niches, formed by triangular recesses, are to be buildable into vertical planted columns and terraces. Terrace-like plant pockets are to be connectible with one another and with the natural ground with the aid of vertical earth columns. Freestanding planted columns are to beautify the environment individually or in combination with one another.

Angle blocks are to be layable into planted walls, columns, escarpment walls, and pillars which are of pleasing design and also exhibit static load-bearing capacity. In addition, it is to be possible to fill the hollow chambers with reinforcements and backfill concrete and to fashion them into reinforced concrete supports and supporting walls. Novel design possibilities are to be offered to the planning and executing personnel in the gardening and landscaping areas. In addition, the individual block is to be of a low weight, i.e. so handy and lightweight that it can be laid by one person with tolerable physical stress.

SOLUTION

This object has been attained by the features of the invention as recited hereinafter. More particularly, angle elements with acute-angled leg ends 13 and flattened leg ridges are built up according to the principle of a masonry bond with vertical joints offset layer by layer. The angle blocks 1, 2, 3, 61, 70, and 98 offer, with their broadly cantilevered basic form, the foundation for a tilt-proof positioning. The angular shape exhibits a favorable moment of inertia, the center of gravity lying within the triangular configuration but outside of the cross-sectional area.

The unilaterally open angular shape permits a material cross section that is smaller in relationship to a closed body and is ideally suited for a compact, nestling stacking without having to ship hollow spaces. The stackability of a product is an important cost factor for production, storage, and transport. The larger the number of pieces per pallet, the more favorable the unit cost.

On account of the high shipping expenses for hollow and trough-like bricks, the delivery radii of these products are restricted and range presently at about 70–125 km in radius. On account of the stackability of the angle bricks in accordance with this invention, delivery radii, trading areas, and thus the markets of the manufacturers can be enlarged; this can lead to a further reduction in unit cost.

As compared with the 90-degree angle block 1, the 60-degree angle block 61 has several additional advantages: it has an equal-sided, even larger basal area, and thereby also a higher moment of inertia, greater buckling strength, and improved capacity for soil. It is possible to form therefrom hexagonal, stellate planting columns (FIG. 10*b*) in a free-standing fashion and/or expandable on each side. Also freestanding, triangular planting columns are possible (compare FIGS. 10*b* and 11*a*). Zigzag walls with depth and bilateral, large earth volume are to be formed from individual molded blocks as well as from wall-high elements (FIGS. 8*a*, 11*a*), in each case also with tier slabs 5 and 5' to obtain plant terraces 7.

The low weight of the angle blocks 1 and 61 of about 28 kg and the advantageous dimensions of 40 cm side length, 25 cm height, and about 6.5 cm wall thickness permit even individual persons to lay the bricks without excessive physical exertion. When using lightweight concrete, these weights can be still further reduced. The aforementioned dimensions can be varied arbitrarily and can be adapted to the prevailing circumstances.

The design of the leg tips 13 and of the brick ridges 14 according to the invention, as illustrated in FIG. 1*a*, makes it possible to join the angle blocks with parallel abutting surfaces in the longitudinal direction 29, in the transverse direction 30, in the leg direction 32, and in intersecting relationship, permitting a regular bridging of the vertical butt joints 26 by the block center 31 of blocks 1, 3, and 61, laid in the subsequent layer rotated by 90° or 180°.

Thereby, a multitude of novel usage and utility possibilities are opened up, in addition to the conventional usages for the known L block, for planning and execution: Adaptation to the terrain with respect to contour and height is readily possible, as well as meeting esthetically sophisticated, individual requirements, for example for columns or acute-angled and wavy wall crests.

The following overview shows the various types of walls, manner of placement, usages, and pecularities which will thereafter be described in greater detail:

A- Types of walls of cornerstones, in zigzag and linear fashion

A-1 abutting in zigzag shape in the longitudinal direction of the wall, to form freestanding walls (FIGS. 1*a*, 8*a*, 9*a*, 11*a*), A-2 abutting in zigzag shape as in A-1, but with spike-like wall crests (FIGS. 7*e*, 8*b*, 9*a*), A-3 abutting in zigzag shape, but in one or two rows from wall-high angle elements 2.

A-4 abutting linearly in the leg direction, with a closed frontal surface, to form freestanding or escarped walls (FIGS. 5*a*, 12*b*), A-5 flatly abutting in the leg direction with intermediate slabs, to form plant tubs and above-ground construction systems (FIG. 12*f*).

B- Angle blocks laid in crosswise relationship to obtain planting walls:

B-1 laid crosswise in layers in single rows to obtain escarpment walls (FIGS. 3*b*, 4*a*), B-2 laid crosswise in layers in double rows to obtain freestanding planting walls (FIGS. 2*b*, 11*a*).

C- Columns and pillars of angle blocks:

C-1 abutting at the leg tips to obtain square columns (FIGS. 6*a*, 11*a*), C-2 abutting at the leg tips to obtain rectangular columns (FIG. 12*b*), C-3 built up in the manner of pie pieces into polygonal and round columns (FIGS. 6*e–h* and FIGS. 11*d–f*), C-4 abutting at the brick ridges in pairs to obtain 4- and 6-chambered or stellate columns (FIGS. 7*d*, 10*b*, 11*a*).

D- System components supplementing the above:

D-1 With tier slabs 5 and 5' to obtain planting columns (FIGS. 1*f*, 7*d*, 8*b*, 10*c*) applicable to A-1, A-3 and C-3, D-2 more stable with respect to tilting, with molded-on base plates 103 (FIG. 8*b*), D-3 with cover plates 104 for tables and stools (FIG. 5*b*), D-4 with cover plates 41 for columns and pillars (FIG. 6*b*), D-5 with intermediate plates 56 for columns (FIG. 6*b*), D-6 with base plates 55 for columns and pillars (FIG. 6*b*), D-7 floor plates 10 and 10' seal, by intersecting, certain brick projections in the downward direction (FIGS. 2*c*, 3*c*), D-8 filling bricks 57 for cross bonds to serve as a form for a concrete core (FIGS. 2*b*, 3*b*), D-9 with connecting braces 67 between the legs for hollow supports to be filled with concrete (FIG. 11*a*), D-10 shading chamfers 76 centrally on the brick ridge 31 (FIG. 1*a*).

E- Cross section types (vertical sections):

E-1 fully solid cross section 1 (FIG. 1*a*),

E-2 cross section 91 with hollow tubes (FIG. 5*d*),

E-3 I cross section 92 with central web (FIG. 5*d*),

E-4 U cross section 93 with unilateral web (FIG. 5*d*),

F- Joint dowel connections and cross rim profilings:

F-1 dowel rods 36 and dowel holes 35 (FIG. 1*e*),

F-2 two dowel rods 36 with butt strap 37 (FIG. 5*a*),

F-3 trapezoidal tongue-and-groove rabbets (FIG. 1*a*),

F-4 cross grooves 34 at the upper cross rim (FIGS. 2*b*, 3*b*),

F-5 cross grooves 34 at the top with H dowel (FIG. 5*a*),

F-6 cross grooves 34 at the upper and lower cross rims (FIGS. 2*d* and 3*b*), F-7 cross grooves 34 at the upper and lower cross rims, with square dowel 87 (FIG. 5*a*), F-8 cross grooves 34 at the upper and lower cross rims, with dovetail dowel 89 (FIG. 5*a*), F-9 cross grooves 34 at the upper and lower cross rims, with prismatic dowel 90 (FIG. 5*a*), F-10 cross grooves 34 at the upper and lower cross rims, with cylindrical dowels 90', 90" (FIG. 5*a*), F-11 rows of cross grooves 86 at the upper and lower cross rims (FIGS. 4*a* and 5*b*), F-12 rows of cross grooves 86 at the upper and lower cross rims, combined with interlocks according to F-4 (FIG. 5*c*), F-13 rows of cross grooves 86 at the upper and lower cross rims with integrally formed octagonal dowels (FIG. 12*e*), F-14 rows of cross grooves 86 at the upper and lower cross rims with integrally formed cylindrical dowels (FIG. 12*e*), F-15 slotted grooves 63 for H, U, Z profile sections (FIG. 7*d*).

A-1: Contours in a zigzag pattern are produced from cornerstones 1, 2, 3 and 61 abutting in the longitudinal direction, in parallel to the longitudinal central plane 29; the butt joints 26 thereof are bridged respectively in the next layer by the brick centers 31 of the angle blocks rotated by 180°. In this way, a rugged masonry bond and a stable wall are produced at the site.

On account of the regular zigzag pattern of a contour according to FIGS. 1*a*, 8*a*, 9*a* and 11*a*, the freestanding wall offers on both sides identical views of the greatly structured surfaces with surface recesses on more than 80% of the respective surface, and with depths of up to 40 cm. The obliquely receding surfaces have an optically pleasing appearance to the observer and have an absorbing and reflecting effect on arriving sound and detonation waves. Owing to the niches, backfilled at least in part with soil in the normal case, and the planting, additional sound absorption and less reflection result so that, making a comparison with existing products, highly absorbent effects can be expected of the wall according to this invention.

A-2: In place of the customary, horizontal wall crests, the invention also permits ascending and descending bed joints 42 and wall terminations. The angle brick 3, shown in FIGS. 9*a*–9*c*, has, as seen in a vertical longitudinal section, two parallel, V-shaped bearing joints 42 at a uniform spacing of the brick height H, ascending or descending from the brick center 31 at about 45° toward the two leg ends. In the transverse direction 30, the bearing joint 33 extends horizontally, as seen in the assembled condition. By joining identical bricks 3 in the longitudinal direction 32, the leg tips 13 come into contact at the butt joint 26 to form ascending and descending shapes.

In the respectively subsequent layer, acute-angled angle bricks 3 are tilted by 180° and seated with their cutout in the brick center onto a tip and over a butt joint of the two bottom bricks. Their pointed leg ends, projecting downwardly, extend into the cutout of two acute-angled angle bricks lying therebelow. In this way, the butt joints 26 are bridged in a regular fashion in the brick center 31 so that also in case of acute-angled angle bricks the same regular masonry bond is produced as in case of the heretofore described angle bricks with horizontal bearing joints.

The first layer should be provided with a horizontal bearing joint 33 since it is seated, as a special form, at the very bottom, on the ground or alternatively on a poured concrete foundation, whereas its upper bearing joint 42 is fashioned to ascend and descend at an acute angle.

In this way, in the assembled condition, the ascending and descending bearing joints 42 and wall crests act as an esthetically designed, dynamic element which can be additionally emphasized by contrasting the layer by means of colors.

In place of the somewhat abrupt and break-endangered acute angles, the leg cross rims can also be designed to be wavy, or they can exhibit other angles of inclination. Of course, it is likewise possible to design also the 60-degree angle blocks 61 and the one-third slabs 69 and 70 for hexagonal and round columns with ascending and descending bearing joints and/or wall crests, and as wall-high elements 2 as in accordance with FIGS. 7*a*–7*e*, 8*a*–8*b* and 9*a*–9*b*, extending not only in a straight line but also as a broken-line course.

A-3: Wall-high angle elements with zigzag joints, set up in one or two rows, are assembled into detonation and visual protection walls (FIG. 8*a* and 8*b*).

A-4: In the leg direction, abutting in parallel to a central leg axis 32, the inner sides 60 of the leg tips 13 touch in each case the brick ridges 14 of the subsequent brick. From angle bricks 1, rotated in layers by 90°, walls with closed frontal surfaces are obtained herein which can be laid in the dry state or with the use of mortar in a composite structure (compare FIG. 5). In a similar manner, it is also possible to produce square and rhombic-design ornamental walls (FIGS. 12*e*, 12*f*).

A-5: Equal-sided 1 or angle blocks 98 with different-length legs can be laid as stable corner points with slabs 99 placed in shape-mating fashion between the leg tips, to obtain plant tubs and for the construction of buildings in the prefabricated mode (FIG. 12*b*).

B-1: Unilateral slope stabilizations according to FIGS. 3*a*, 3*b*, 4*a*–4*c* and 11*a* are obtained with a single intersection crossed transversely to the central axis 32 of the leg in the leg center 72 and interlocked with the aid of cross grooves 34, 86, 95, 96. Contours having a zigzag shape can be placed one above the other, as illustrated in FIGS. 3*a*, 3*b*, 4*a*, 4*b* and 4*c*, in the manner of steps, set back, such as contour lines for securing escarpments. The interlocking and/or doweling of the individual layers takes place, in case of FIGS. 1*a* and 4*a*, by means of dowel rods, in case of FIGS. 2*b*, 3*b* and 11*a* by means of interlocking cross grooves 34.

Insofar as the tongue-and-groove elevation edges 25 are utilized as illustrated in FIGS. 1*b* and 1*d*, the tongue-like raised sections can also be used in crossovers by recessing the elevated edges at the points of intersections, or breaking them off subsequently by means of a hammer. The elevated edges beside the points of intersections that remain standing then act as shear safety means.

B-2 Angle blocks 1 and 61, crossed in pairs to obtain freestanding planted walls according to FIGS. 2*a*–2*d* and 11*a*–11*f*, can be combined in pairs, in contact at the leg tips, to obtain hollow shapes, and they can be staggered in the longitudinal direction respectively by one-half diagonal length 22 per layer, and can be interlocked. By means of the bottom slabs 10 and 10', the brick ridges 14, projecting laterally above the recesses, and/or the leg pairs 13 are sealed off in the downward direction, and the bricks are locked together. The filled-in soil lies embedded in the plantable projections, yielding planting terraces 7 in the upward direction in connection with the earth core in the interior of the wall; consequently, their plant roots can reach all the way to the natural ground (compare FIGS. 2*a*–2*d*, 3*a*–3*c*.

The butt joints of the angle brick pairs of FIGS. 2*a*–2*d* and 11 extend first in the longitudinal wall direction 29 and in the subsequent layer in the transverse wall direction 30; with the connecting clamp 11 and 11' or with the dowel rods with butt strap 37, respectively two leg ridges 14 can be clamped together (compare FIGS. 2*a*–2*d*, 11*a*–11*f*).

Another laying method for the planted wall illustrated in FIGS. 2*a*–2*d* provides that angle bricks with cross grooves 34 abut at the upper cross rim in the longitudinal wall direction 29 and are centrally crossed by the subsequent layer. In each third layer, the angle bricks 1 are offset in the transverse wall direction 30 with cross grooves 34 as transverse brackets between two parallel layers.

In order to heighten an existing garden wall 74 with a planted wall without having to tear down the former, it can be bricked up with the wall of half-brick thickness made up of simply crossed angle bricks according to FIGS 3*a* and 3*b*, in order to extend, above the base, the wall in whole brick thickness as illustrated in FIG. 2*a*–2*d*.

C-1: Two equal-sided right-angled cornerstones 1 in contact with each other at their leg tips 13 form an inwardly hollow, square contour for supports and pillars. The subsequent layers are in each case rotated by 90° and placed with their butt joints 26 onto the brick centers 31. The same outline can also be made up of solid trough blocks 97 and can be combined with base slabs 55, intermediate slabs 54, and cover slabs 41 (FIGS. 6*a*–6*h*).

C-2: Support contours having a rectangular outline composed in the same manner as in C-1 can be formed from rectangular angle blocks 98 with unequal legs. The same contour can also be formed from solid trough blocks 102 (FIG. 12*a*–12*f*).

C-3: Angle and segment bricks staggered in the manner of pieces of pie can be composed into angular or round column outlines. Respectively three elements 69 and 70 result in hexagonal, dodecagonal, and round supports. From respectively two angle bricks 1 and 77, quadrangular columns can be formed, and from respectively four segmental blocks 82, octagonal columns can be made. When abutting in the transverse direction 30 and in contact with each other at the leg tips 13, angle elements 1, 2, 3 and 61 yield hollow-chambered, tetragonal, hexagonal, octagonal, even-numbered contours for individual supports and pillars in several layers staggered in the composite wall (compare FIGS. 1*a*–1*g*, 6*a*–6*h*, 11*a*–11*f*.

In this arrangement, the angle or segmental blocks 1, 69, 70, 77, 82, 98 are combined in layers into a closed column contour and are placed, according to the bricklayer principle, in the subsequent layer with the block center 31 onto a butt joint 26 lying therebelow (compare FIGS. 6*a*, 6*b*, 6*e*, 6*f*, 6*g*, 6*h*; FIGS. 11*d*, 11*e*, 11*f*; FIG. 12*b*).

C-4: In contact with each other along their backs in pairs, 90-degree angle blocks 1 can be laid in a masonry bond in layers, offset by 90°, for forming four-chamber planted columns according to FIGS. 7*a*–7*e*. If respectively three 60-degree angle blocks 61, offset with a 60° interspace, are composed into a six-chamber planted column with their backs in contact, then six identical planting chambers are produced (see FIGS. 10*a*–10*d*). The subsequent layer is rotated by 60° so that an angle block in each case covers the interspace located therebelow and a butt joint.

If 60-degree angle blocks 61 are in each case rotated by 60° per layer and placed directly one on top of the other, then in case of three layers each of the three sides is provided with a plantable opening and two closed sides; here, too, the earth is held back by tier slabs and is formed into terraces (no figure).

D-1: On both sides of the niche-like angle brick walls and planting chambers according to FIGS. 1*a*–1*f*, 7*a*–7*e*, 8*a*–8*b*, 9*a*–9*e*, 10*a*–10*d* and 11*a*–11*f*, the receding niches can be fashioned, by insertion of trapezoidal tier slabs 5 and 5', as plantable terraces with vertically passing-through earth columns 8. The tier panels 5 and 5' necessary for this purpose rest with two bearing points 49 on the perpendicular wall of the angle bricks 1, 2, 3 and 61. The supports are either an integral part of the block, in the form of thickened portions or lateral, groove-like indentations, insert slots, or supporting plates, or they can be connected laterally by dowels after the wall has been built up. The tier panels 5 retain the soil core 8 in the rearward direction in the niche and, in the forward direction, present—as seen in a vertical sectional view—wedge-shaped, plantable bays, so-called planting pockets and/or plant terraces 7.

The segmented recesses 6 and linear recesses 6' of the tier slabs 5 and 5' form, in the installed condition, openings at the bottom of the respective plant tiers. The soil filling, sliding along the incline of the tier slabs in the rearward direction, drops in the corner of the niche through the bottom opening 6 and 6' through to the plant tier located therebelow and forms, after each tier has been completely filled up, natural sloping angles of about 20° inclination from the outer top edge 23 of the lower tier slab up to the inner bottom edge 24 of the upper tier slab 5 and 5'.

In the course of time, the filled-in earth will settle in the downward direction on account of natural compacting. The design of the planting tiers in accordance with this invention takes the natural settling phenomena into account by allowing the soil to slide along the obliquely oriented tier panels 5 so that, in the corner zone 6 of the niche, there will always remain a continuous column of soil. Settled areas are automatically fed from the soil content of the individual tiers and can be recognized from the front as indentations and can be replenished (FIGS. 1*a*–1*f*, 7*a*–7*e*).

The continuous soil core 8 in the corner of the niche is important for an easy-care and successful planting. The roots can grow down to the earth core to the lower tiers; if the plants are permanent, the roots can extend into the natural soil and will supply themselves with moisture with the aid of the capillary action. Therefore, there is no need for constant watering. Individual, isolated plant pockets without a vertical soil core would be subject to drying out or would have to be watered artificially.

It is recommended to plant the horizontal areas of the upwardly open plant pockets 7 with plants which in each case grow toward the bottom and toward the top, such as, for example, ivy, woodbine, or similar plants. In the periphery of the plant pockets, the wall surface will show plant growth in spotwise fashion relatively quickly, so that also high walls can be fully overgrown within a short time. By planting on vertical concrete walls, green areas which are ecologically valuable and optically pleasing are created while simultaneously enhancing the noise damping effect.

D-2: Base slabs 103 formed integrally with cornerstones, broaden the basal area of the wall (FIG. 8*a*). Loads of filled-in soil or other weights exerting pressure on the base slabs result in an additional moment of resistance against horizontal forces and impart to a thus-equipped wall an increased stability. Therefore, such a wall can absorb higher loads, for example as a supporting wall against earth pressure or, in case of a freestanding setup, can be built higher than comparable walls without base slabs.

D-3: Cover panels 104 correspond in their contours to the area formed from the outer leg rims 18 and a diagonal 22 and are adapted to the upper cross rim of an angle block 1 with corresponding recesses, and can be placed on this block and joined in shape-mating fashion. With their aid, angle bricks can be made into stools and tables.

D-4 to D-6 relate to cover plates 41, intermediate plates 54, and base panels 55 used for the construction of columns and pillars and described in greater detail in the description of the figures relating to FIG. 6*c*.

D-7: The bottom panels 10 and 10' of FIGS. 2*a*–2*d* and 3*a*–3*c* are required for vertical walls in a crossover laying pattern in order to close the projecting regions of the downwardly open angle bricks and to utilize the filled-in soil for projecting planting terraces.

D-8: If desired, the openings for the plantable terraces 7 of FIGS. 2*a*–2*d* and 3*a*–3*c* can be entirely closed with filler blocks 57. This may be necessary in order to provide an external form for interiorly located hollow chambers; these can be made into supporting posts 58 by filling with reinforced concrete. Such supports may perhaps be necessary also merely in the bottom layers of a wall from a static viewpoint while the upper layers of the support, filled with soil, are fashioned into open planted terraces. Also in case of the singly crossed wall according to FIGS. 3*a*–3*c*, individual hollow chambers can be backfilled to obtain reinforced concrete supports 58 which, as shown in FIGS. 3*a*–3*c*, for example, are suitable as an abutment for sheet walls 59.

D-9 Angle blocks with molded-on concrete webs 67 between the legs can be formed into supporting columns by placing the hollow chambers in superimposed relationship; these supporting columns can be reinforced and can be filled with concrete. In this arrangement, the braces extend in parallel to the leg ridge 14 at an arbitrary location between leg tips and leg backs (FIG. 11*a*). Also these angle blocks can, of course, be horizontally serrated with one of the joint profiles F-1 through F-15.

D-10: The vertical chamfers 76 centrally in the leg ridge 14 have the width and appearance of a butt joint 26 located therebelow or thereabove and serve as an ornamental design element for continuing the vertical joints 26 of the layer disposed therebelow in the block center 31 as a shadow joint 76 (FIG. 1*b*).

E-1: The fully solid vertical cross section of the angle bricks 1 is suitable for mechanical block production. In this method, concrete is filled from above into steel forms and compacted. Thereafter the form opens up downwardly in order to release the earth-moist blank.

E-2: An externally solid cross section 91 has interiorly disposed hollow chambers for saving material and weight. As in tile production, soft-plastic material, for example loam, is extruded as an angular profile and cut off from the strand of profile member in correspondence with the desired length. The hollow tubes extend in parallel to the extension of the extruded member in the leg center 32 and are visible at the sectional areas 23 and 24 as polygonal, round or elliptical holes (FIG. 5*d*).

E-3: I-shaped cross sections 92 according to claim 28 exhibit a slender central web in the leg center 32 and bilaterally molded-on thickened portions in the region of the cross rims 23 and 24. The central web can be reinforced on both sides by ribs extending between the cross rims. Such cross sections 92 can be manufactured by the plastic injection-molding method for toys, where the intent is to be able to save expensive material (FIGS. 5*a*–5*f*).

E-4: U-shaped cross sections 93 have a continuous web in the zone of the outer rims 18 of the legs, with two molded-on flange sections in the region of the cross rims 23 and 24, suitable as grasping strips during laying. Wood or concrete can be utilized as the material.

F-: Various doweling and interlocking modes described in the claims permit securement of the horizontal joints in a shear-safe manner against horizontal forces. They facilitate assembly and increase the stability of walls and pillars. The alternative to be utilized in practice in a particular case depends, on the one hand, on the purpose of use of the angle block and, on the other hand, on the respectively preferred production and assembly techniques of the manufacturers and the processing companies. Basically, all disclosed utilizations for angle blocks (compare A-1 to C-4) can be equipped with one or several of the joint formations described hereinbelow.

Some machines for brick manufacture permit, for example, the recessing of grooves only in the upper cross rims whereas no cutouts may be located in the lower cross rim. For this purpose, the top-positioned cross grooves 34 could be employed which permit intersecting staggering according to FIGS. 2*a*–2*d* and 3*a*–3*c*, with the smooth lower cross rims locking into the cross grooves 34 of the upper cross rims of the block located therebelow. A type of placement according to FIGS. 1*a*–1*f* would require additional H-profile dowels 88 according to FIGS. 5*a*–5*f* to be inserted in the cross grooves 34.

According to claim another feature, the upper as well as the lower cross rims in each case are provided with cross grooves 34 which interlock in a dual manner by the intersecting of two angle bricks.

The cross rims of angular toy building blocks of a synthetic resin would preferably be profiled, by the injection-molding method, with finely detailed rows of grooves, just about impossible to manufacture in concrete, as described in F-11 through 14 (FIGS. 5*a*–5*f* 11*a*–11*f*).

The description of the figures delves in detail into the various joint profilings. Besides the dry laying methods, it is, of course, also possible to join the bearing joints with mortar. For this purpose, with a block width of about 6.5 cm, a joint height of about 5–8 mm is recommended.

The indicated practical dimensions can, in proportion, be enlarged and reduced almost in any desired way, in accordance with the requirements, the materials employed, manufacturing and transportation means, and static calculations.

BRIEF DESCRIPTION OF THE FIGURES

The invention is illustrated in drawings as follows, wherein:

FIG. 1*e*, shows the perspective of a typical wall section of angle blocks 1 according to the invention.

FIG. 1*f*, shows the contour of a tier slab 5.

FIG. 1*g*, shows the chamfer 56 of the leg tip 13 in outline.

FIG. 2*a*, shows the outline of a freestanding wall according to FIG. 2*b* with angle blocks 1, in each case combined into hollow members, with rim recesses 34 for interlocking at their points of intersection.

FIG. 2*b*, shows the perspective for the outline 2*a* with the layers I–IV.

FIG. 2*c*, shows the vertical section I—I with the bottom slabs 10 and the connecting clamp 11.

FIG. 2*d*, shows a filling block 57 in a perspective view.

FIG. 7*d*, shows the perspective of an angle block 2 with upper cross rims converging at an acute angle toward the transverse center plane 30.

FIG. 12*d*, shows the illustration of an ornamental wall with various cross rim profilings and with a square trough block 97.

DESCRIPTION OF THE FIGURES

Figure 1A:
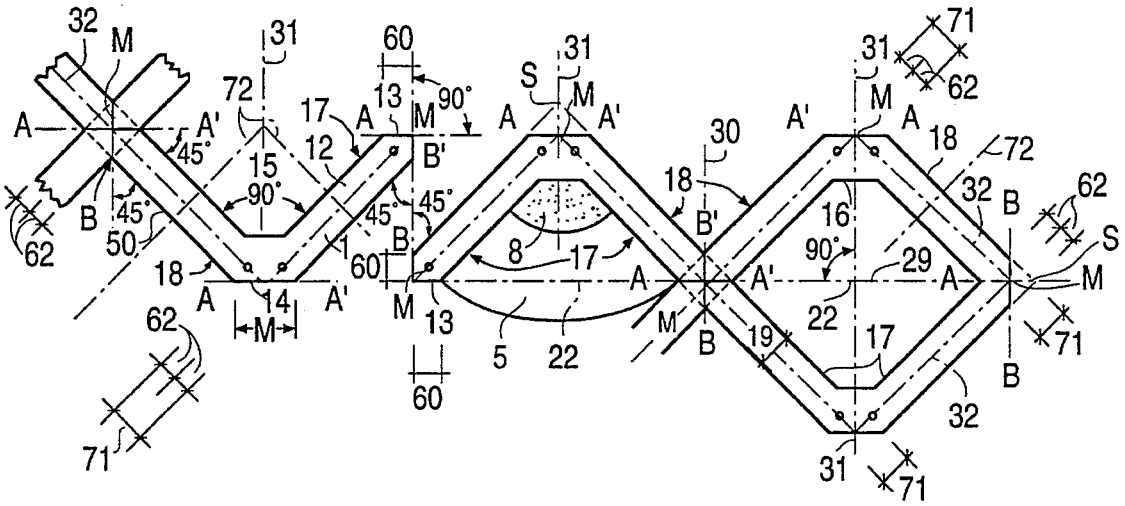
FIG. 1*a*, shows angle blocks 1 according to the invention in outline.

FIG. 1*a*, shows 90-degree angle blocks 1 according to the invention in outline, extending in each case with their diagonals 22, their block ridges 14, and an associated side 60 of the leg tips 13 in parallel to the longitudinal center plane 29, the two sides 60 of each leg tip being right-angled. The projection of the leg ridges 14 onto the central axis 32 of the legs results in a length 71 twice as long as the projection 62 of a leg tip 13 onto the plane 32.

The two cornerstones with downwardly pointing leg tips 13 have a common longitudinal joint M-B in the transverse center plane 30 of the wall. This butt joint M-B is bridged in a second layer, to be placed thereon, by the left angle block. The left block, rotated by 90°, points upwardly with its leg tips 13 and thus covers the two angle blocks lying therebelow from block center 31 to block center 31.

Four angle bricks 1, contacting one another with their leg tips 13 in the center M, form a joint square A–B–A'–B, the edge length of which corresponds to the leg thickness 19. The diagonals A–A' and B–B' of the square correspond to the length of the block ridge 14, and half of the diagonal side A–A' and B–B', respectively, corresponds to a triangle leg 60 of the leg tips 13 which are equal-sided rectangular.

At the bottom, a second angle block 1 with the contact surfaces A–M and A'–M is joined to the right-hand, uppermost angle block 1. As a pair, the two angle blocks 1 form a closed, approximately square hollow elements for plant containers and hollow columns. The subsequent layer is constituted by a further angle block pair, rotated by 90°, the butt joints A–M of which are seated over the block centers 31 of the lower block pair.

Figure 1C:
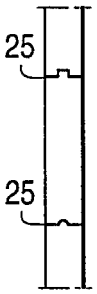
FIG. 1*c*, shows an angle block 1 in cross section with a tongue-and-groove rabbet 25.
Figure 1D:
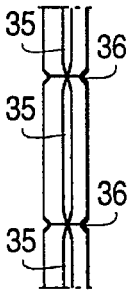
FIG. 1*d*, shows an angle block 1 in cross section with holes 35 and dowel rods 36.
Figure 1B:
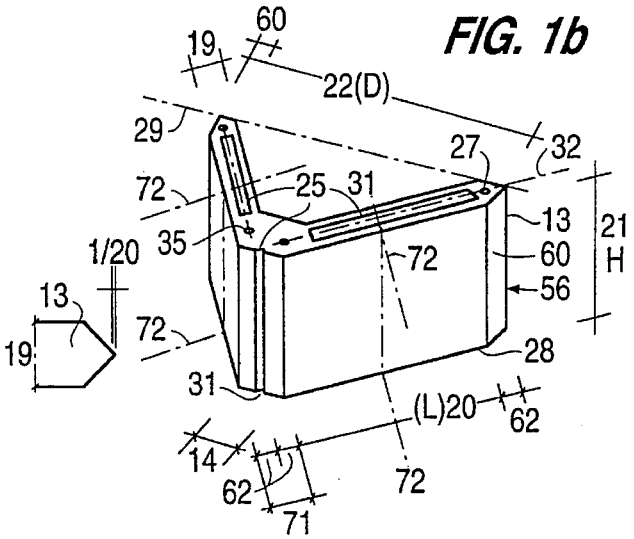
FIG. 1*b*, shows an angle block 1 in a perspective view.

FIG. 1*b* shows the angle brick 1 in a perspective with a leg length 20 (L)=36.5 cm, a height 21 (H)=25 cm, a thickness 19 (d)=6.5 cm, and a diagonal 22 (D)=51 cm. Four round dowel holes with a diameter, flaring conically in the upward direction, of about 10 mm and a depth of about 35 mm are disposed on the leg center axes 32 of the upper and lower cross-sectional surfaces. Also, the upper cross-sectional surfaces 27 are provided with raised portions of a trapezoidal profile in parallel to the leg center axis 32 of about 2 cm in height, and the lower cross-sectional surfaces 28 are equipped with groove-like indentations of a shape complementary thereto.

FIG. 1*c* shows the cross section I—I through the angle block 1 of FIG. 1*b* with tongue-and-groove bearing joints 25 having a trapezoidal cross section, as one of several interlocking modes.

FIG. 1*d* shows the cross-section II—II through the angle block 1 of FIG. 1*b* with dowel holes 35 and rod-shaped dowels 36 in the bearing joints, as one of several interlocking modes.

FIG. 1*e* shows the perspective of a typical wall section of angle blocks 1, laid in a masonry bond with staggered butt joints. One of the triangular niches is bulkheaded off toward the open side with obliquely inserted tier slabs 5; the latter encompass, in the rearward corner zone, a vertical earth column 8 and form, in tiers, plant terraces.

The closed hollow form illustrated on the right-hand side is made up of two angle blocks contacting each other with the inside of the leg tips 13. The blocks of the next following layer are in each case rotated by 90° so that respectively one block center 31 bridges the butt joint 26 lying therebelow. The closed hollow forms can be left vacant, can be filled with soil, or can be backfilled to form reinforced concrete supports at any desired location to rigidify the wall.

In order to dowel the horizontal joints 27, dowel rods 36, with or without connecting straps 37, are inserted in the round holes 35, designed as a complement thereto, of the superimposed blocks, wherein respectively four dowel holes of a leg are mutually aligned with the four dowel holes of the legs in parallel thereto, pertaining to two angle blocks lying thereabove and/or therebelow. In addition to and/or as an alternative to the dowel rod connection 36 and 37, the horizontal doweling can take place with the aid of the tongue-and-groove interlock 25 according to FIG. 1*c*.

FIG. 1*f* shows the cross section of two tier slabs 5 and 5' having approximately the shape of pie sections, with an acute angle 15 of about 70° (at a 90° angle between the angle block legs) which is delimited by the pointedly converging outer rims. The tier slab 5 and 5' is urged forwardly by its own weight and by the load of the soil, in a longitudinal axis extending in parallel to 29, with a load distribution that tends to be oriented slightly forwardly, supported by two bearing points 49 formed integrally with the angle block wall on the side or connected by dowels, and is fixed in a rearwardly inclined oblique position. A forward tilting is prevented by the feature that the outer edges of the tier slabs are urged upwards in the rearward zone and are wedged in place on the walls of the angle slabs.

The segment-like recess 6 and 6' provided at the tip of the tier slab defines approximately a hollow space as a fourth of a circle having a radius of about 17 cm; this space can be filled with earth and connects, as a continuously extending, vertical earth column, the individual planted tiers with one another down to the natural ground. The roots can grow within the earth core 8 downwardly into the natural ground, and the capillary action will cause moisture to rise upwardly to the individual plant tiers. Therebeside, on the left, the trapezoidal tier slab 5' is illustrated with linear edges and a corner 6' that is cut off straight. This alternative is intended for situations wherein the forward edge is not to project beyond the longitudinal plane of symmetry 29.

FIG. 1*g* shows the outline of a leg tip 13 with chamfer 59, provided for preventing breakage of the edge. According to this, the height of the chamfered triangle amounts to 1/20 of the leg thickness 19.

FIG. 2*a* shows the outline of a freestanding planted wall of cornerstones 1 arranged crosswise in pairs, these blocks being composed in pairs into hollow forms first in the longitudinal direction 29 and then in the transverse direction 30, and are placed in this way. The upper 27 and lower cross-sectional areas 28 are interlocked at the points of intersection 51 by flat, rectangular cutouts 34 having a groove depth of about 6 mm. The bottom slabs 10 serve as additional rigidifying means for the angle blocks; these slabs close off in each case the laterally projecting block protuberances in the downward direction and prevent the soil for plant terraces 7 from dropping through.

FIG. 2*b* shows the perspective of a planted wall in connection with the outline 2*a*, with the layers I–IV descending stepwise toward the left and closed off toward the right by a wall-high angle element 2. The structure of the wall is built up as follows:

1. The wall is surveyed, staked out, and marked.

2. Humus is dug out down to the natural, load-bearing ground.

3. Foundation concrete is introduced in a layer of about 15 cm down to the frost-penetration depth of 90 cm. Hollow chambers having a diameter of about 20 cm are hollowed out in the concrete for subsequent root penetration.

4. The first tier I is laid in proper alignment and horizontally; the angle blocks extend in the longitudinal direction 29 of the wall.

5. In the second tier II, the block pairs are shifted by one-half block in the longitudinal direction and, rotated by 90°, placed in such a way that the cutouts 34 interlock at the points of intersection 51 of the leg bisecting line 72, and the vertical joints 26 extend in parallel to the transverse center plane 30.

6. By means of the bottom panels 10, the projecting protuberances are closed off in the downward direction, and the layers are interlocked.

7. By means of the connecting clamp 11, the backs 14 of the blocks are joined; twin rod dowels 36 with fishplate 37 are suitable for this purpose as well.

8. Any desired plant tiers can be closed off with filler blocks 57 of FIG. 2*d*. The chambers disposed therebehind can be reinforced 43 and grouted with concrete 58 in order to reinforce the wall in critical zones.

The upper 27 and lower cross-sectional areas 28 of the filler blocks 57 can be equipped, as in case of the angular blocks 1, with dowels 36, profile members 64, 65, and profilings 25.

9. During or after the rough structure has been built, it can be backfilled with soil or earth substrate. Finally, the terraces are planted.

Figure 3A:
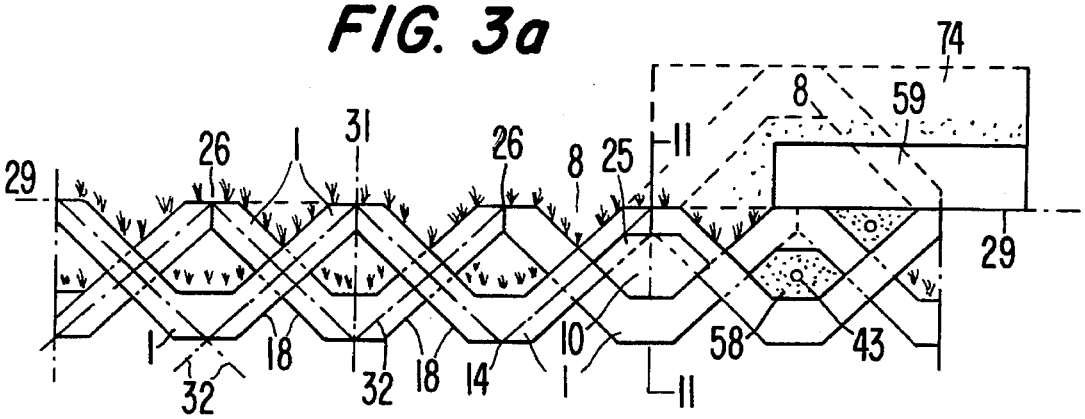
FIG. 3*a*, shows the outline of a vertical terrace with staggered plant tiers, a concrete-filled hollow chamber 58, and the sheet wall 59.

FIG. 3*a* shows the outline of singly intersecting, intermeshed angle blocks 1 for a vertical slope stabilization. The intermeshing of the superimposed block layers is achieved by recesses 34 fashioned to be mutually complementary, in each case at a right angle to the leg rims 23 and 24, in the region of the points of intersection 51 of the central leg axes 32, which recesses are cut out from the upper and lower cross-sectional surfaces; the cutout width is slightly wider than the leg width 19, thus having a width of about 7 cm with a cutout depth of about 6 mm.

Singly crossed layers can be built on, as a wall having the width of half a block, to an existing plinth 74. Above the plinth 74, the wall width can be doubled to amount to the full block width, and can be placed and built up further as a doubly crossed layer, as illustrated in FIGS. 2*a*–2*d*.

Figure 3C:
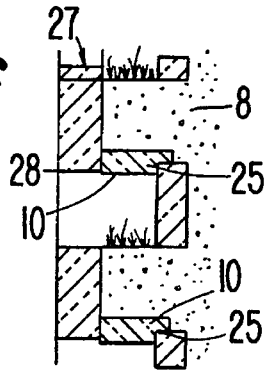
FIG. 3*c*, shows a vertical section I—I with angle blocks 1 and bottom slab 10.
Figure 3B:
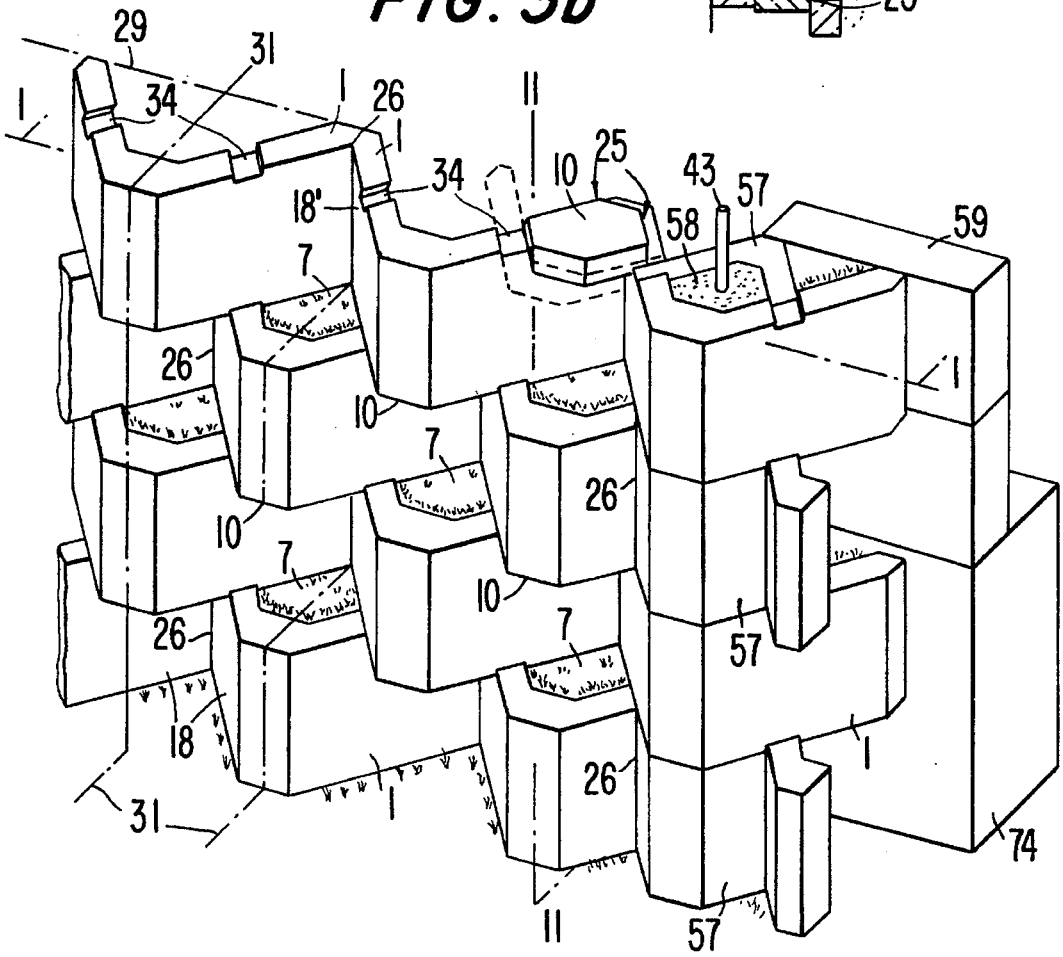
FIG. 3*b*, shows the perspective of the vertical terrace of view 3*a* with recesses 34 at the points of intersection, base slab 10, and sheet wall 59.

FIG. 3*b* shows the perspective of a vertical slope stabilization shown in FIG. 3*a*. The angle blocks 1 are built into the wall structure with an offsetting in the longitudinal direction 29 of respectively one-half block length per layer.

The leg rims 18 dropping back toward the vertical joint 26 form plant terraces 7 above the projections lying therebelow. The bottoms of the respective projections are closed by bottom slabs 10 which latter, with their forward slab rims, extend complementarily to the adjoining rims of the angle blocks 1 and contact these at least with half their slab thickness. Toward the rear, they cover, with their protruding rabbets, the vertical joint and portions of the leg edges of the lower blocks. The floor slabs 10 moreover act as rigidifying elements and horizontal disks between the adjoining angle blocks.

In order to reinforce the rigidity of the wall, angle blocks 1, as illustrated in FIG. 3*b*, can be closed with filler blocks 57 into hollow pillars and grouted to form reinforced concrete supports. As a design variation, horizontal sheet walls 59 of crossties or concrete panels can be utilized behind a hollow chamber 58 filled with concrete in this way, in order to retain earth. The two lower layers are built onto an existing wall plinth 74; a second row of angle blocks can be laid on top of the surface of this plinth.

FIG. 3*c* shows a portion of the vertical section I—I with two plant tiers, closed below by bottom panels 10, with the rearward rabbet 25 of the bottom panels 10.

Figure 4B:
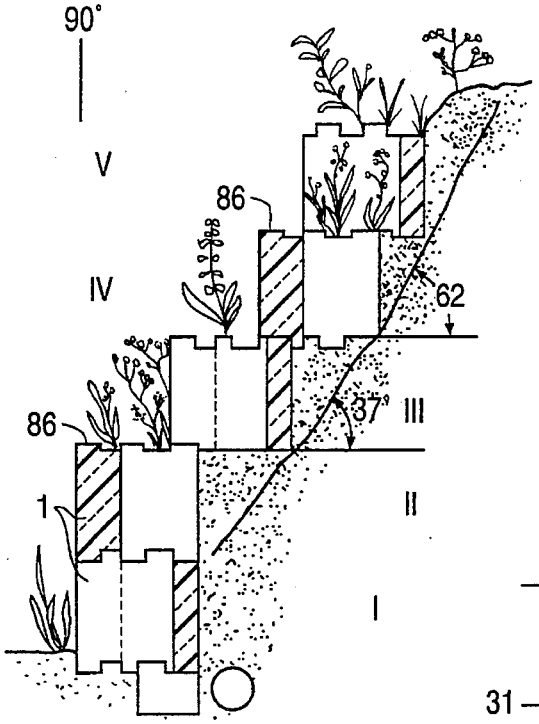
FIG. 4*b*, shows a vertical section of FIGS. 4*a* and 4*c*, with the plantable stone terraces I to V.
Figure 4C:
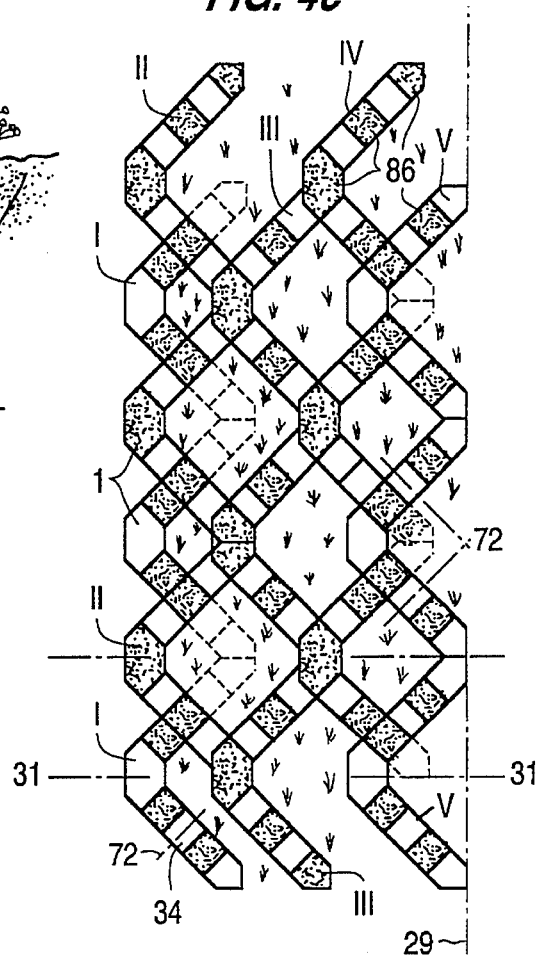
FIG. 4*c* shows the outline of angle blocks 1 superimposed in layers for stabilization of a slope.
Figure 4A:
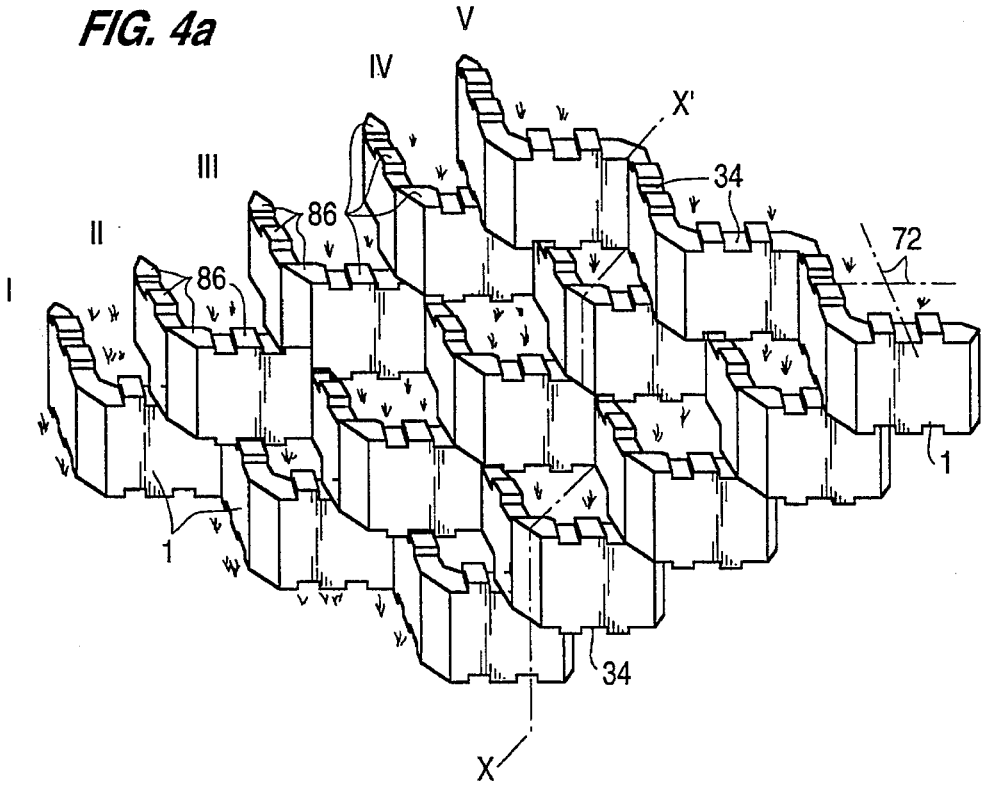
FIG. 4*a*, shows the perspective to the outline of FIG. 4*c* and the sectional view of view 4*b*, with terraces toward the rear and toward the side.

FIG. 4*a* shows the perspective of a slope paving structure made up of angle blocks 1 placed in staggered superimposed arrangement; the blocks are provided at their upper and lower cross rims with U-shaped cutouts 34 and, respectively, raised portions 86 which are designed complementarily to one another. The row of groove-shaped profiling starts on the leg axis 31 as an indentation 34 with a width slightly wider than the block width, here being about 6.2 cm. In alternation, toward the left and right, follow respectively a raised portion having a width of 6.0 cm and thereafter again an indentation, etc., up to the leg end. Consequently, in case of an angle block of normal size of about 36.5 cm leg length and 6 cm leg thickness, there result, per upper leg rim, two raised portions of a height of about 2.5 cm and three indentations, as illustrated at the upper cross rim of the uppermost row.

The lower cross rim exhibits three raised portions and two indentations and thus locks into the upper cross rim of an identical block seated therebelow, e.g. of the third row. The intersecting and interlocking of the central indentations of two angle blocks is shown between the first and second rows where the second row is inverted, the vertical joints of the lowermost row are in each case bridged in the block center, and this intermeshing connection at the bearing point results in a shear-safe connection in the longitudinal and transverse directions.

Another type of intersecting and locking of two cutouts is shown between the fourth and fifth layers wherein respectively the indentations on the uphill side, of the two indentations present at the leg cross rim, are interlocked. However, this is possible only in every second layer.

If, of the two indentations, those on the downslope side would be interlocked, the result would be that the fifth layer would overhang the fourth layer on the downhill side, which would make little sense in case of horizontal bearing joints. However, if the blocks are laid with a horizontal joint inclined toward the slope, an overhang of a layer past the layer disposed therebelow can definitely make sense. Thereby, the angle blocks can hug the slope with strong inclination and can form steeper slopes. The friction of the horizontal joints, their anchorage and their abutment against earth pressure are increased. Consequently, the load resultant of earth pressure and weight of the wall is favorably affected.

FIG. 4*b* shows a vertical section in connection with FIGS. 4*a* and 4*c*. The individual stone terraces I through V can be planted. In the points of intersection of the angle blocks, the cutouts of the upper and lower cross rims lock into the horizontal joints between the first and second layers, as well as the fourth and fifth layers whereas the third and fourth layer each is seated with its cutout in the block center 31 on the raised portions, disposed thereunder, of two contacting leg tips, bridging and holding together the vertical joint thereof.

One advantage of the block form according to this invention becomes especially apparent here: The angle blocks, open on the slope side, form terrace edges serrated toward the downhill side, behind which the natural ground is located without the impediment of a second wall, customary in case of closed hollow members. As a result, the plant tiers can obtain a satisfactory amount of moisture from the slope and can be well rooted. Besides, the omission of a wall leads to a one-hundred percent saving in material and weight, as compared with closed hollow members.

For locations that must be especially well rigidified, the angle blocks, by the formation of closed hollow columns according to FIG. 3*a* and 3*b*, can also be formed into inclined reinforced concrete pillars and grouted.

The most shallow slope inclination of about 37° is obtained with the type of placement as utilized from layer II to III and from layer III to IV. The slope extends perpendicularly between the first and second layers while the inclination is 62° between the fourth and fifth layers. Flatter slopes can be attained by placing the block layers directly on the ground rather than on a block layer disposed therebelow. In this case, the disadvantage must be tolerated that the blocks cannot be interlocked with one another any more.

FIG. 4*c* shows the outline of angle blocks 1 which are superimposed and intermeshed, for slope stabilization. The top edges of the plant terraces, each of which has a height of 25 cm, are characterized by numbers I–V and correspond to the tiers of FIGS. 4*a* and 4*b*.

In place of the groove profilings 34 and 86, it is also possible to countersink dowel hole rows 35 at regular spacings at the cover and bottom surfaces of the angle blocks 1. Intersecting angle blocks can be doweled together in a shearproof fashion by means of rod dowels 36.

Figures 5A, 5B, 5C, 5D, 5E, 5F:
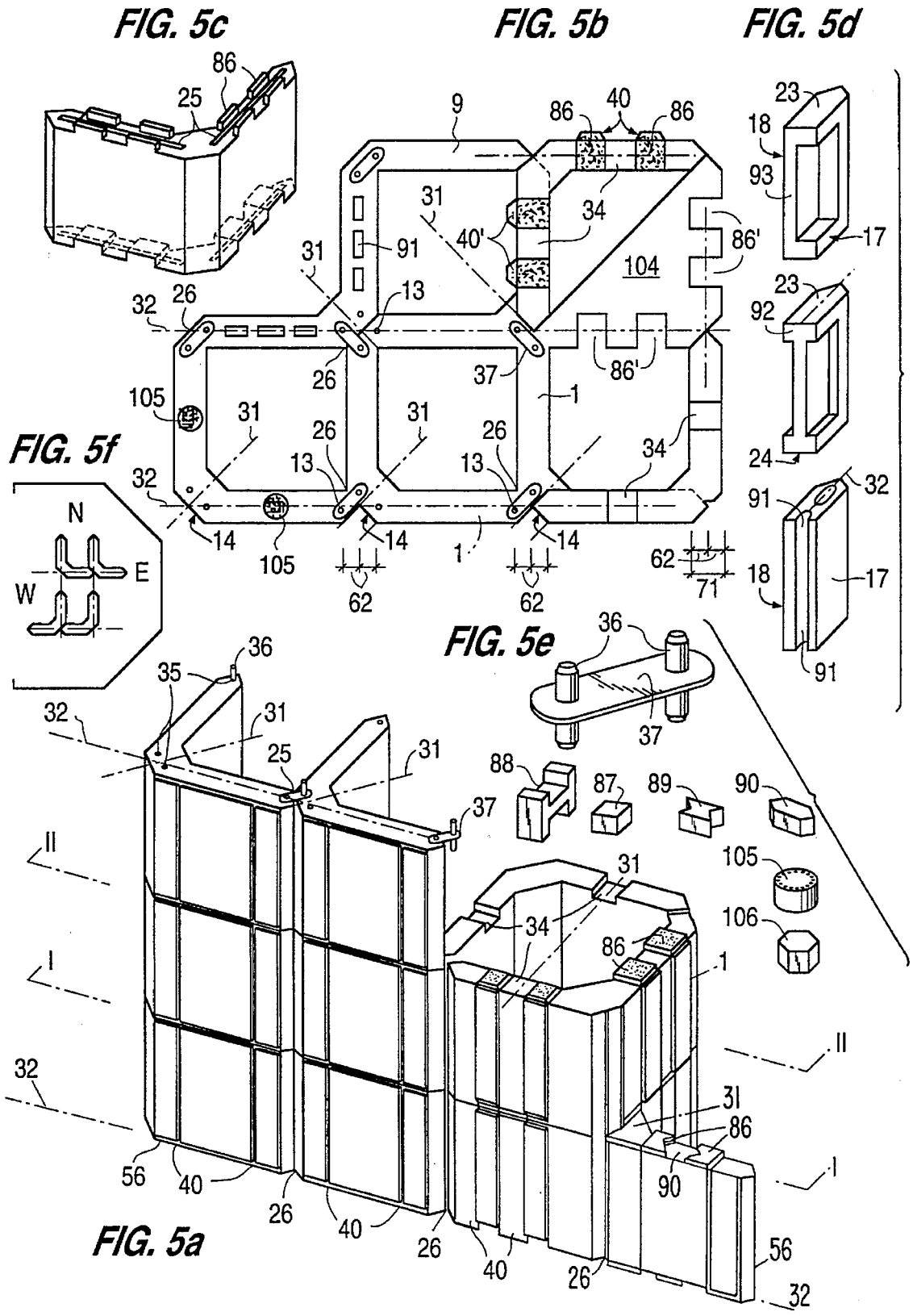
FIG. 5*a*, shows the perspective of a stone wall built up of angle blocks 1 and closed on the front side, with various cross rim profilings 34 and 86 and several types of dowels.
FIG. 5*b*, shows the outline of the first and second layers, various rim profiles, and the cover slab 104.
FIG. 5*c*, shows the perspective of an angle block 1 with rim profilings, combined from 25 and 86.
FIG. 5*d*, shows the perspective of three different-type angle block profiles: U-shaped 93, T-shaped 92, and of a hollow shape 91.
FIG. 5*e*, shows two dowel rods 36 connected by means of a plate 37.
FIG. 5*f*, shows a laying sketch for the wall of FIG. 5*a*.

FIG. 5*a* shows the perspective of an escarpment or garden wall closed on the front side, made up of angle blocks 1. The individual layers are laid so that in each case the legs on the front side are rotated by 180° in the longitudinal direction 32 of the wall in each layer (FIG. 5*f*) so that the legs of one layer point toward the right and, in the subsequent layer, point toward the left, whereas their rearwardly oriented legs stand on top of each other. Along the external face of the wall, respectively one leg tip 13 contacts the leg ridge 14 of the subsequent block. The layer seated on top thereof bridges in each case the joint 26 lying therebelow with its block center 31.

For closing a rearwardly open layer, plate-shaped half-blocks 9 are inserted between two leg tips 13. In this way, closed cavities can be formed, be it for reinforcing the wall rigidity, providing reinforced concrete pillars, or be it for sealing the rearward wall surface for a freestanding erection with possible filling with concrete or soil.

The satisfactory stability of the wall according to FIG. 5*a* can be still further improved by inserting rotproof mat fabric or earth anchors between the horizontal joints of the rearward legs. The subsequent backfilling with earth acts as a surcharge on the mat, thus increasing the inherent weight of the gravity type wall and counteracting the slope pressure.

Insofar as the horizontal joints are interlocked with dowel rods, the four dowel holes 35 of one cross-sectional area must in each case be aligned with the two by two holes 35 of two block halves lying therebelow and/or thereabove and must be joined by means of inserted dowel rods 36. The profilings 40 and recesses at the joint 26 and, respectively, at the block ridge 31 serve for optical purposes and design.

The perspective of FIG. 5*a* shows several alternatives of horizontal doweling. The two right-hand upper transverse edges show, as already known from FIGS. 4*a*–4*c*, symmetrically to the leg bisectrix respectively two raised portions 86 and three cutouts per leg which can be brought into shape-mating engagement with the lower transverse rim profilings complementary thereto; in this arrangement, the edges of the protuberances 86 extending transversely to the outer rims 18 can be designed with an inclination of about 5° to 45° with respect to the vertical.

For design reasons, the raised portions 86 can extend as profiled edges 40' between the cross rims 23 and 24 along the outer and/or inner wall surfaces.

The third cross rim from the right exhibits cross grooves 34 in the leg center, as already described in FIGS. 3*a*–3*c* and 4*a*–4*c*. Insofar as the lower cross rims are likewise provided with cross grooves 34, two superimposed grooves can be brought into shape-mating engagement with each other by complementarily designed rectangular dowels 87 or H-shaped profile members 88. Analogously, dowels with a dovetail-like 89, angular 106, or round 105 contour can be made to engage in shape-mating fashion with recesses forming a complement thereto and can thus be mutually aligned in the longitudinal and transverse directions of the wall and doweled together safe from shear.

Prism-like dowels 90 can also be integrally formed at the lower leg rim and can be brought into shape-mating engagement with the recesses 90' of the upper leg rims, complementary thereto; compare FIG. 5*a*, bottom right-hand corner.

However, in case the lower cross rims must be manufactured to be smooth and without cutouts, as required in special production techniques, the flange of the H-profile member 88 can dip into the upper cross groove 34 and align, with its parallel flange sections, the walls of the block placed thereon in parallel to the lower block.

FIG. 5*b* shows the outline of the first (I—I) and second (II—II) layers, shown one inside the other and showing furthermore several alternative cross rim profilings: cross rims with cutouts 34, with raised portions 86, with hollow chambers 91, and with dowel holes 35. The illustration likewise includes an equal-sided—rectangular cover panel 104 with the recesses 86' at the short triangle sides, engageable in shape-mating fashion by the protuberances 86 of the angle blocks, with the aid of which stools and tables can be created. The cover slab 104 can be extended on each of the three sides wherein the recesses 86' appear as square cutouts. To serve as a complementary counterpart to the lower cross rim profile 86 with respectively two indentations per leg rim, the corresponding angular slab 104' is equipped with two tines on each of the two short triangle sides.

FIG. 5*c* shows the perspective of a cornerstone 1 with a groove-like profiling 86 and 25 at the cross rims. Along the central leg axis 32, the raised portions 86 carry groove-shaped notches whereas the depressions 86 are provided with additional tongue-shaped forms 25. The upper rim surface can be brought into shape-mating engagement with the lower rim surface which latter has a complementary configuration, the double serrations 86+25 providing a locking engagement safe from shear in the longitudinal and transverse directions.

FIG. 5*d* shows three different transverse profiles of the angle block 1 affording, alternatively to the full wall thickness, statically tolerable cross-sectional reductions and thus savings in material and weight. As a result, special material properties and production methods can be taken into account.

The uppermost U-shaped cross section 93 exhibits a unilaterally slender web with two parallel flange sections whereas the I-shaped cross section 92 is equipped with a central web. Both cross sections can be cast, for example, in concrete or synthetic resin, or they can be glued together from wood. The webs can be additionally reinfored by vertical ribs. Ergonomically, the horizontal reinforcements of the cross rims constitute grasping strips, with the aid of which the angle blocks 1 can be more easily carried and placed more satisfactorily.

The hollow profile 91 has parallel, closed outer walls and interiorly disposed, tubular cavities and is suitable for extrusible postcuring materials, to be processed in the plastic state, such as ceramic.

FIG. 5*e* shows two rod dowels 36 joined by means of a plate 37. The plate, of about 30×120 mm, acts as a tension plate to bridge vertical joints and likewise as a spacer means for easier assembly, and consists of a sheet metal having a thickness of about 2.5 mm, or of a synthetic resin with two perforations for the rod dowels 36. The plate 37' can, of course, also be of a polygonal shape, equipped with three and more holes, in order to pass through one of the holes, for example, a vertically penetrating reinforcement steel bar 43 so that, by providing the corners with a form and grouting, reinforcement ribs 58 can be created (compare FIGS. 5*a* and 5*b*). The dowel rods 36 have a length L=45 mm and a thickness D=6 mm and can be loosely inserted in the plates 37, or they can be joined to the plates 37.

FIG. 5*f* shows a laying sketch for the wall illustrated in FIG. 5*a*. The lowermost layer points toward the west with its frontal legs and, in the second layer, points toward east, whereas its legs oriented toward north stand perpendicularly above each other.

Figure 6A:
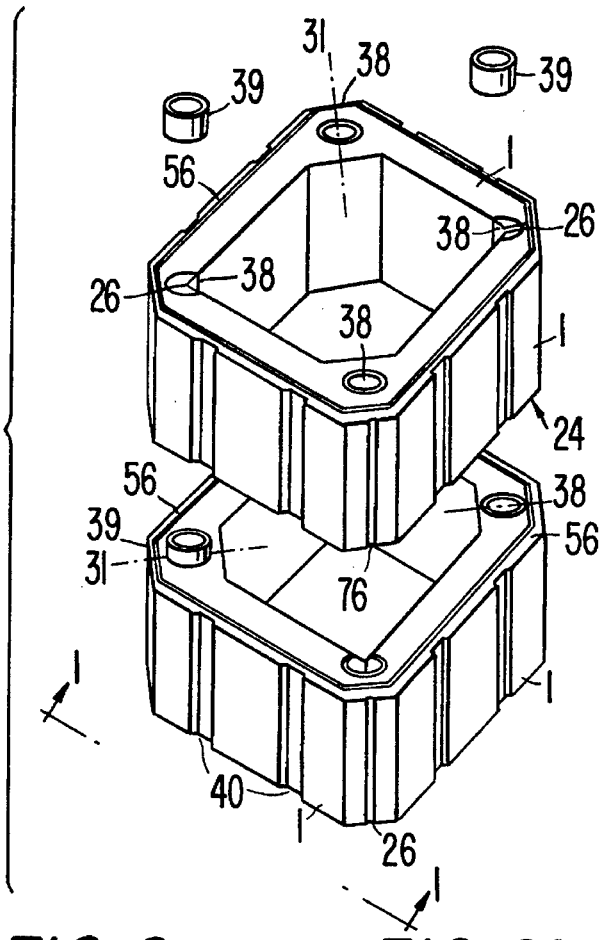
FIG. 6*a*, shows the perspective of two layers of a pillar construction, rotated by 90°, made up of angle blocks 1 with ring dowels 39 as connectors.

FIG. 6*a* shows the perspective of a pillar construction of angle blocks 1. Two angle blocks, in each case contacting each other in pairs with their leg tips 13 at the joint 26, form a square outline with an enclosed cavity. The respectively subsequent layer is rotated by 90° so that vertical joints 26 are bridged by the block centers 31 of the next layer.

As an additional connection feature, and as an alternative to the previously illustrated rod dowels 36, which are also suited for this purpose, ring dowels 39 are placed in the groove-like recesses 38 of complementary configuration in order to achieve horizontal as well as vertical dowel connections.

Figure 6B:
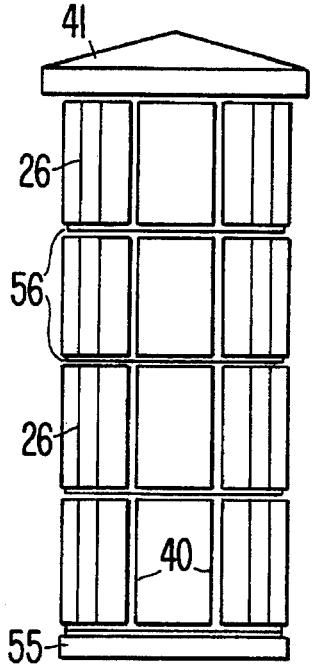
FIG. 6*b*, shows the illustration of a finished pillar with base and cover slab 41, composed in the manner of FIG. 6*a*.

The outer surface of the angle block is provided with haunch-shaped depressions 40 which impart to the column of FIGS. 6*a* and 6*b* and, respectively, to the wall of FIG. 5*a*, a textured appearance, in the form of shadow joints extending, in the assembled condition, perpendicularly and through multiple tiers. In the zone of the upper 23 and lower cross rims 24, the edge 56 is chamfered so that, in the built-up condition, the horizontal joint lags by about 6 mm behind the surface of the block, and horizontal shadow grooves are formed.

FIG. 6*b* shows the illustration I—I of a finished pillar erected in the manner of view 6*a* and having a height of about 1.10 m with a bottom slab 55 and a cover slab 41, as it can be used as a garden and gate pillar or in building construction, with the height corresponding to a story.

Figure 6C:
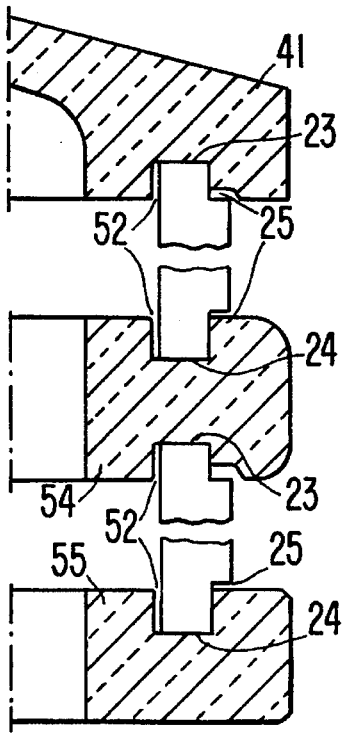
FIG. 6*c*, shows the cross section with tongue-and-groove rabbet connections, the base slab 55 and cover slab 41, as well as an intermediate ring 54.

FIG. 6*c* shows the cross section through a pillar according to FIG. 6*b* with cover plate 41, base plate 55, and an additional (possible) intermediate plate or ring 54, insertable for design reasons. The plates or intermediate rings, provided with grooves 52, bridge the perpendicular butt joints with their block centers, according to the same principle as a masonry bond. The raised rabbets 25 of the web plates are recommendable, but not absolutely necessary. By means of these rabbets, a critical weakening of material at the grooved formed components can be avoided.

Figure 6E:
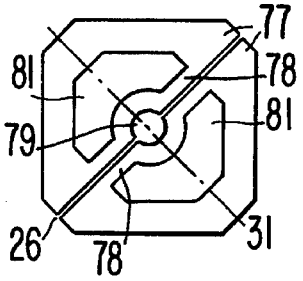
FIG. 6*e*, shows the outline of a square column composed of two angle blocks 77. The leg tips of the angle blocks are joined by an additional, diagonal brace.

FIG. 6*e* shows the outline of a square column composed of two angle blocks 77. The diagonal brace 78 connects the two angle block tips and imparts to the block a higher rigidity and an improved stability whereby assembly is facilitated and accelerated. With a reinforcement and concrete grouting of the hollow chambers, special stability requirements, as demanded for freestanding pillars and columns in part, are likewise fulfilled. The semicircular recess 79 of the brace 78 results, when two angle blocks 77 are joined, in a circular cutout in the center of the outline which can be perpendicularly reinforced and grouted with mortar. Also, the remaining hollow chambers can be grouted throughout.

Figure 6F:
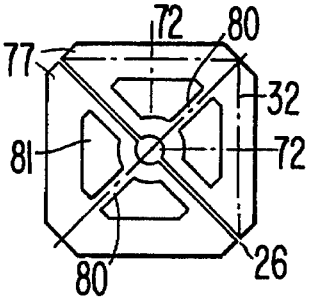
FIG. 6*f*, shows the subsequent layer with respect to the outline of FIG. 6*e*, with an additional, alternative bracing in the transverse center plane 31.

FIG. 6*f* shows the subsequent layer of the outline of FIG. 6*e* of a square column composed of two cornerstones 77. With the block center 31 thereof, the vertical joint 26 lying therebelow is bridged. An additional, alternative brace 80 in the transverse central plane 31 imparts additional strength to the hollow block 77.

Figure 6G:
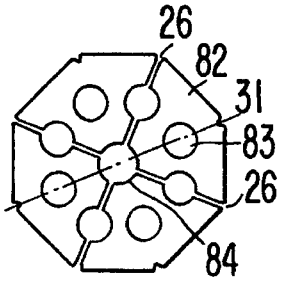
FIG. 6*g*, shows the outline of a regular octagon as formed from four identical segment blocks 82.
Figure 6H:
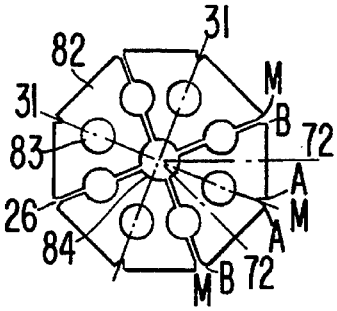
FIG. 6*h*, shows the outline of the layer following next to the arrangement of FIG. 6*g*.

FIG. 6*g* shows the outline of a regular octagon composed of four identical segmental blocks 82. The vertical butt joints between the blocks 82 form, in top view, a cruciform which is rotated from one layer to the next in each case by one-half block, by bridging the vertical joints 26 of one layer by the block centers 31 of the subsequent layer (FIG. 6*h*). The circular cutouts on the axes of the vertical joints 26 and of the block centers 31 form tubular cavities extending vertically through the rotated block layers.

Figure 11E:
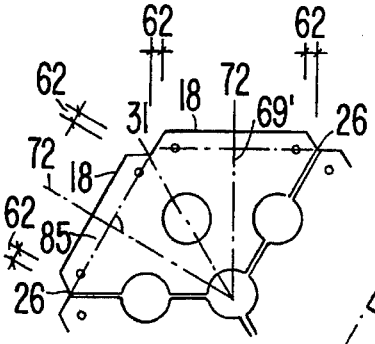
FIG. 11*e*, shows, as an alternative to the one-third slab 69, a one-third hollow block 85 with enlarged base area and circular cutouts.

FIG. 6*h* shows the octagonal contour of the layer following subsequently to FIG. 6*g*. In place of the two outer surfaces of a segmental block 82, the outer surface can also be subdivided into smaller sectional areas so that any desired polygonal outlines all the way to a round column are possible. Hexagonal and dodecagonal outlines can be formed from respectively three segmental blocks, as illustrated in FIG. 11*e*. For this purpose, the segmental blocks 69 and 70 can be designed as hollow stones such as 82 and 85.

Figure 7A:
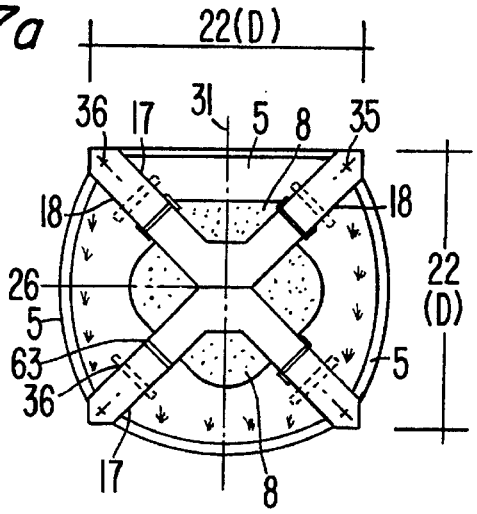
FIG. 7*a*, shows the cruciform outline II—II of FIG. 7*d* of a planting column with four plant chambers and a tier slab 5' with linear edges.

FIG. 7*a* shows the cruciform outline II—II of a plant tower made up of angle blocks 1 abutting in pairs at the back 14, with a vertical joint 26 in the east-west direction. Two of the four rectangular chambers are constituted by the inner leg rims 17, and two chambers by the outer leg rims 18, i.e. by the 90° interspaces. The chambers can be filled with soil perpendicularly, in that obliquely inserted tier slabs 5 and 5' close off the openings in terrace fashion and retain the earth core 8 in the corner of the chambers.

Figure 7E:
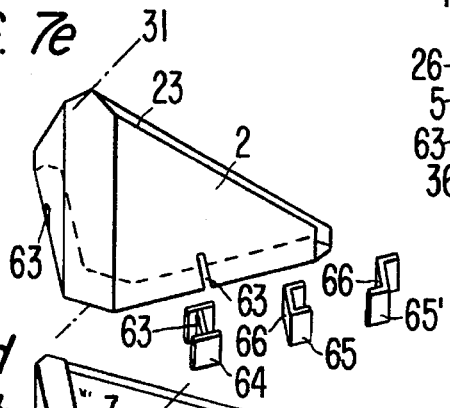
FIG. 7*b*, shows the cruciform outline I—I of FIG. 7*d* of a planting column with four plant chambers.
FIG. 7*c*, shows the illustration III—III of two tiers of FIG. 7*d*.
FIG. 7*d*, shows the perspective of a planting column of angle block pairs 1 joined in a crosswise manner, with the H-, U- and Z-shaped profiled connectors 64, 65 and 65'.
Figure 7D:
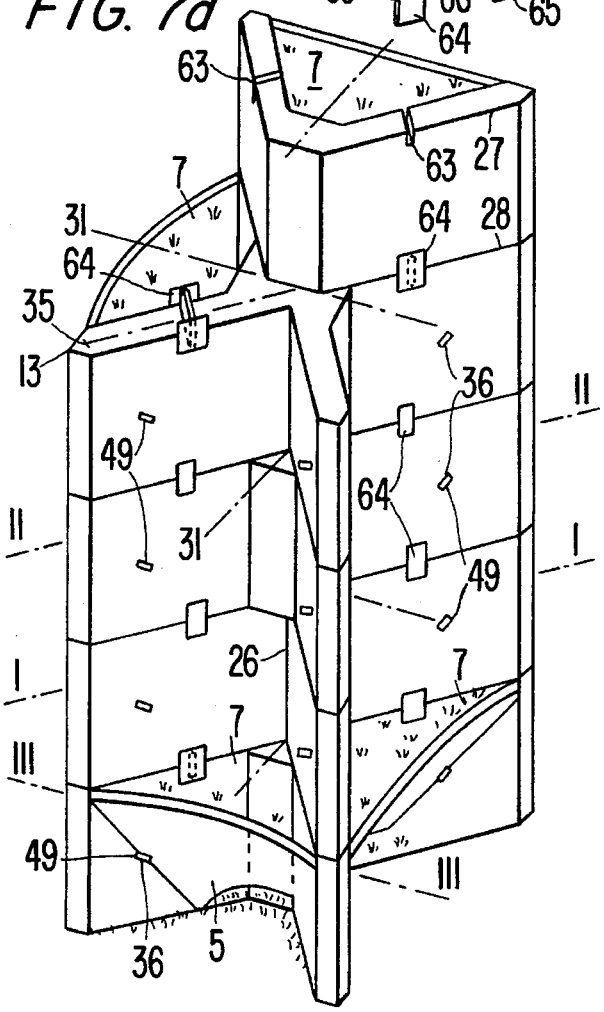
Figure 7B:
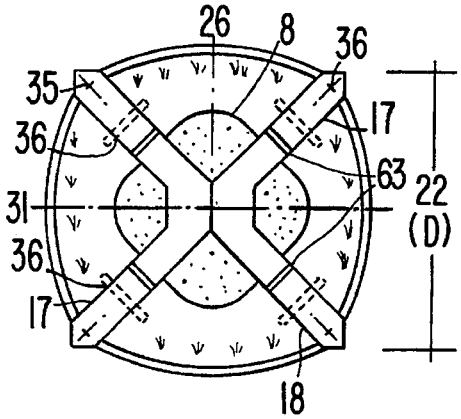

FIG. 7*b* shows the subsequent layer of the cruciform contour I—I of FIG. 7*a*, but the cornerstones which are in contact in pairs are turned by 90° so that their common butt joint 26 now extends in the north-south direction. The 90° rotation in each layer has the result that each butt joint 26 is bridged in the next following layer by two angle blocks in the block center 31.

With this stable placement mode in the manner of a masonry bond, a multilayer cruciform column can be stressed and calculated like a homogeneous, cross-shaped profile. An additional bond between the layers is achieved by doweling with H-, 64, U-, 65, or Z-, 65' profile members which are fitted in the leg center into fitting, groove-shaped recesses transversely to the central leg axis and thus mutually align the superimposed legs. In this case, the alternative use of dowel rods 36, usable in hidden fashion, can be omitted. The remaining joint configurations F-1 through F-15 are likewise suitable for this laying method.

Four dowel holes 35 and, respectively, 91 are provided per block for the alternative doweling of the horizontal joints. These holes coincide with the two by two holes 35 of the leg pairs-located therebelow and thereabove, so that layers can be joined with eight dowel rods 36. In order to simplify assembly, it is also possible to bridge the butt joints 26 by means of double-rod dowels with fishplate 37.

Figure 7C:
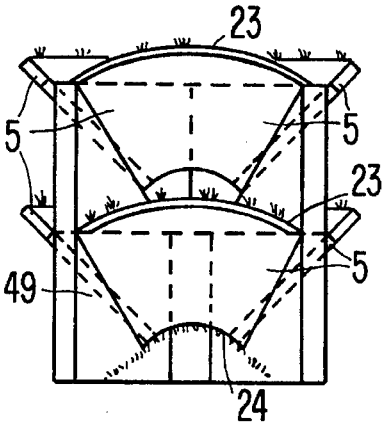

FIG. 7*c* shows the illustration III—III of two layers of angle blocks 1 placed cross-shaped in the assembly, with installed and filled-up tier slabs 5. The plantable terraces 7 extend, in their inclined surface, respectively from the outer upper cross rim 23 of the lower tier slab to the lower cross rim 24 of the upper tier slab 5.

FIG. 7*d* shows the perspective of the cruciform plant tower with plant tiers in the lowermost and uppermost layers. The layers 2–4 show the block strata respectively rotated by 90° wherein in each case a butt joint 26 is bridged by a block center 31. The horizontal rod dowels 36, laterally inserted in dowel holes 35 of the stone walls, serve as a bearing 49 for the tier slabs 5 and 5'

As the uppermost termination and as an optical accent, a cornerstone 3 having a pointed upper cross rim is placed, in FIG. 7*e*, onto the normal cornerstones.

Figure 8A:
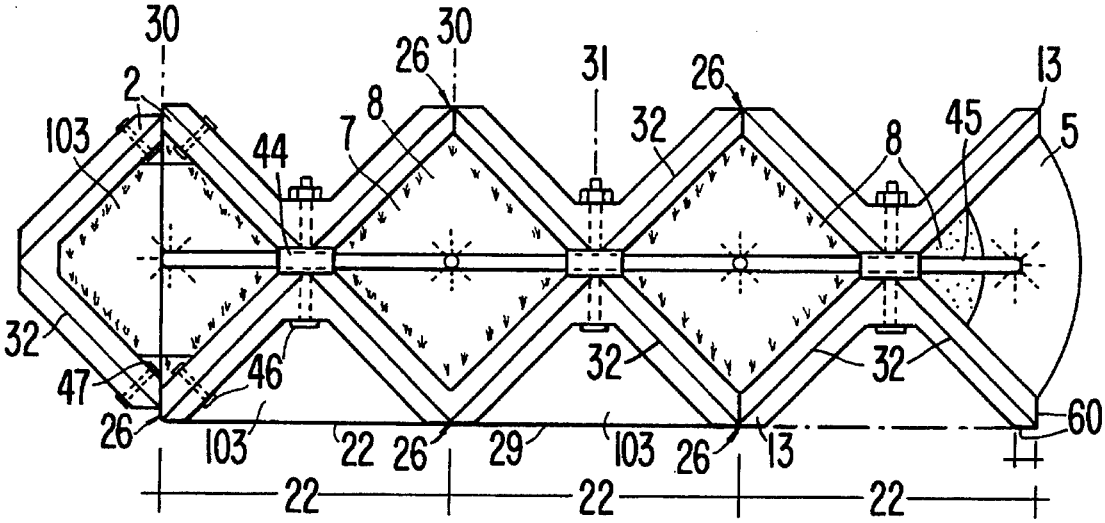
FIG. 8*a*, shows the outline of the wall of FIG. 8*b* with wall-high angle blocks 2, screwed together at the back in pairs, and therebetween a sprinkler conduit 45.

FIG. 8*a* shows the outline of a planted wall made up of three wall-high angle elements, threaded together in pairs in the transverse direction 31 by means of screws 46; these angle elements are placed in side-by-side relationship in the longitudinal direction 29 to form fillable hollow chambers and are in contact with each other at the butt joints 26 with their free leg tips 13. Between the backs 14 of the angle elements 2, cubical concrete or rubber blocks 44 are inserted as spacer means in the zone of the screws 46, so that an interspace of arbitrary size can be produced, here illustrated with about 8 cm. The fixedly doweled and threaded-together spacer means 44 form the bearings for a sprinkler conduit 45 laid in the longitudinal direction, permitting an automatic watering of the hollow chambers with respectively one nozzle per chamber.

The single angle element 2 laid on the left-hand side in the transverse direction 30 closes off the wall and is connected to the free legs of the associated angle blocks with the aid of steel angles 47 extending across the corner and screws 46. The base panel 103 formed at the bottom points into the interior of the wall and is provided with a high stability on account of the earth load resting thereon. The right-hand end of the wall is closed off in terrace fashion by tier plates 5.

In place of the spacer means 46, it is also possible to recess, in the back 14 of the angle elements 2, cutouts for passing horizontal watering and tension pipes 45 therethrough.

Figure 8B:
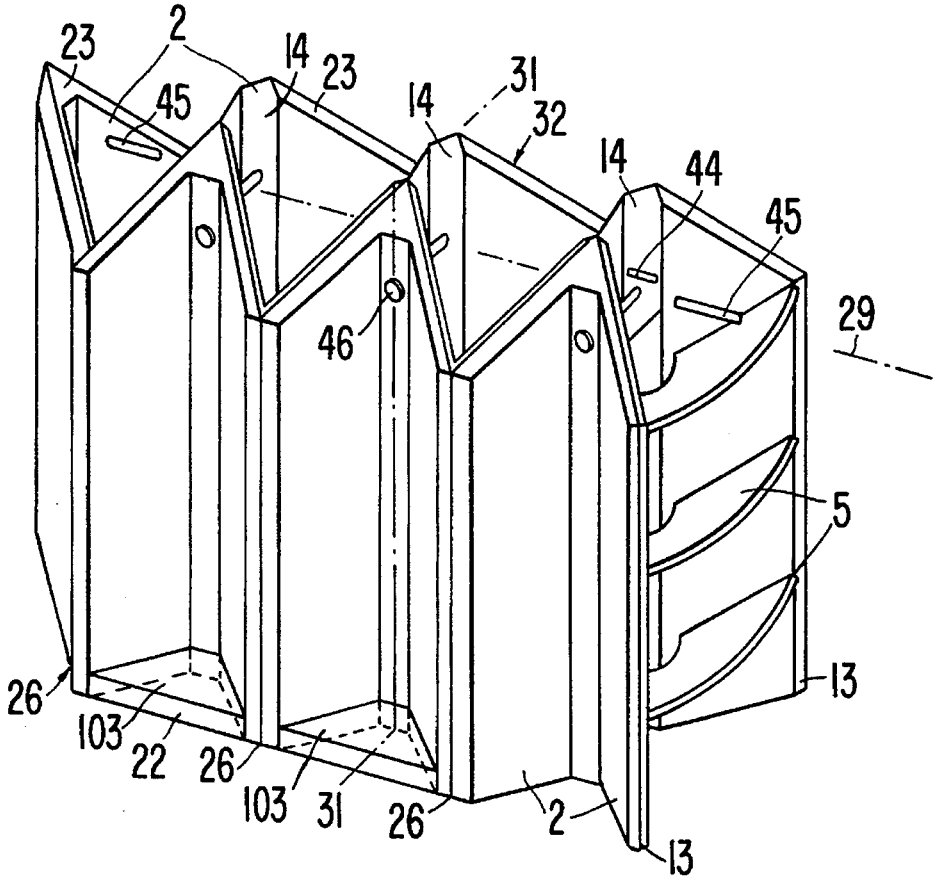
FIG. 8*b*, shows the perspective of a garden wall made up of wall-high angle blocks 2, with base slab 103, an acute-angled wall crest, and three tier slabs 5.

FIG. 8*b* shows the perspective to the outline of FIG. 8*a* of the wall formed from angle elements having a height of about 1.2 m. The leg length 20 is about 40 cm, the thickness 19 is about 7 cm. The upper cross rims extend from their leg tips in a pointed way upwardly toward the transverse plane of symmetry 31. The cross-sectional areas are beveled in the manner of a gabled roof from the central leg axis 32 which is raised in the manner of an arris line.

In place of wall-high angle elements 2, the two parallel kinked walls can also be built up of angle blocks 1 having a height of about 30 cm in the composite structure of FIG. 1*e*. In a fitting manner, the pointed wall crest can be formed with angle blocks 2 according to FIG. 7*e*.

The upper wall crest, extending in zigzag fashion, is offered as an additional design element, last not least in order to impart to the noise-damping, visual protection wall and the safety walls a more friendly character. In place of the angular zigzag shape, the wall crest can, of course, also consist of rounded, gently undulated upper cross rims 23.

In case of unilaterally occurring sound and explosion waves, a soft earth filling, for example of soil substrate, can act as a buffer and vibration damping medium between the angle elements.

With reinforcement, the angle elements 2 can be built up to heights of about 4 m and thereabove, by anchoring them in concrete foundations and by bracing them optionally additionally with bending-resistant struts and multiple threaded connections between the elements against horizontal forces.

After backfilling the hollow chambers with earth, the wall crest can be planted in an ecologically valuable fashion and with the optical effect mitigating the safety character of the wall.

The perspective according to FIG. 8*b* shows on the left-hand side two angle blocks 2 with base plates 103 formed in parallel to the bottom cross rim surface; these base plates offer additional rigidification to the angle elements 2. The diagonal 22, extending between the leg tips 13, and the leg rims define the base plate 103 connected to the leg walls in a statically effective manner.

The walls of the angle elements are in effect set rigidly fixed on the ground, in conjunction with bearing loads on the base plates 103 in the form of earth or other weights, such as plant tubs, for example. As a result, with increasing loads bearing on the base plates, the stability of the angle blocks is enhanced, and thus freely set-up angle elements with base plate can be higher than those without a base plate 103. Therefore, base plates should preferably point into the interior of an earth-filled wall, as in case of the outermost left-hand cornerstone illustrated in FIGS. 8*a*–8*b* in order to exploit any earth loads that may be present, for increasing the stability.

If an angle block with base plate is inverted, a block of this arrangement with cover slab can be utilized as a stool, a table segment, or as half of a hollow column. By placing identical parts in side-by-side relationship, the halves can be completed into square-shaped members, compare FIG. 5*b*.

The stackability of cornerstones remains preserved basically also with unilaterally attached base and cover slab, but the stack will be increased in height in each case by the thickness of the base slabs.

Figure 9C:
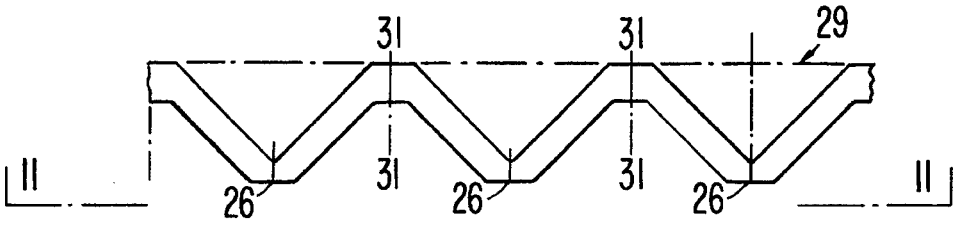
FIG. 9*c*, shows the cross section I—I of the wall of FIGS. 9*a* and 9*b*.
Figure 9B:
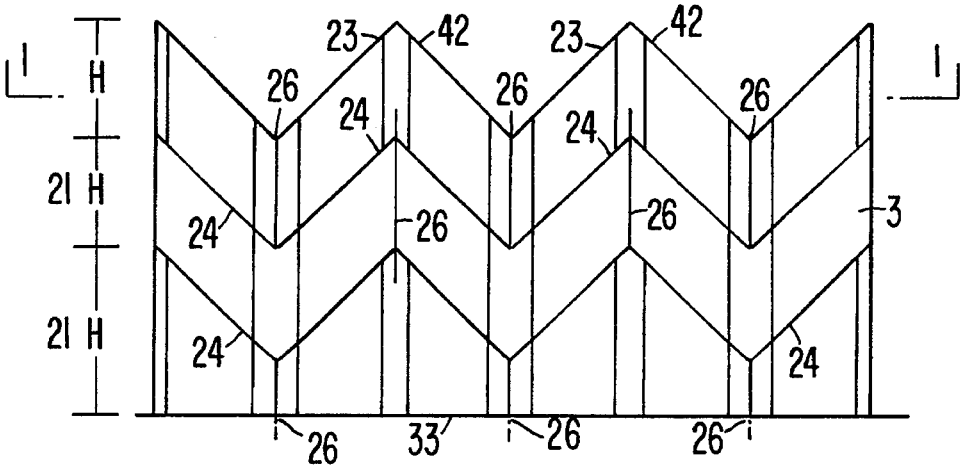
FIG. 9*b*, shows the illustration II—II of FIG. 9*a*.
Figure 9A:
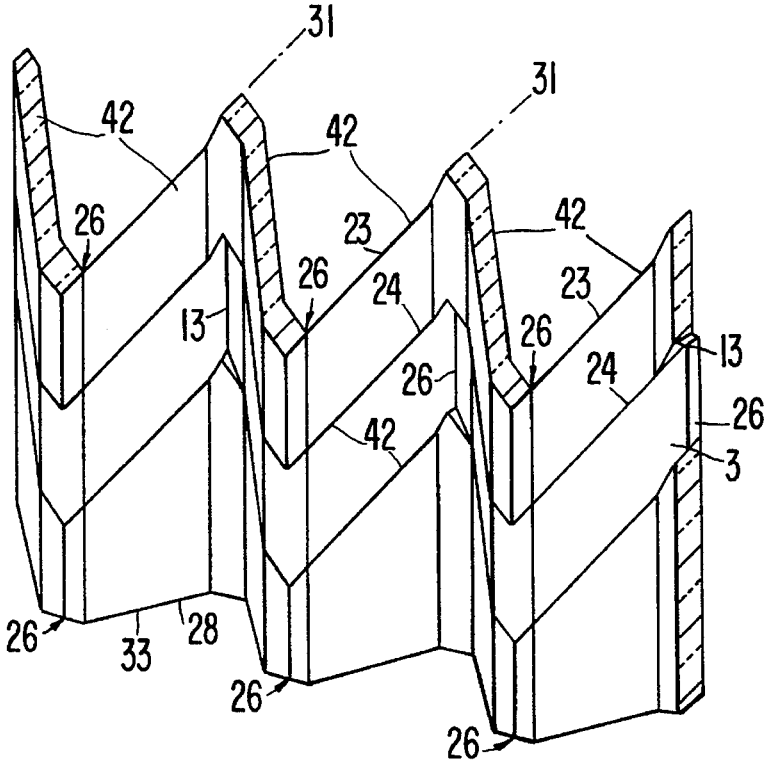
FIG. 9*a*, shows the perspective of a garden wall made up of angle blocks 3 with acute-angled bearing joints 42.

FIG. 9*a* shows the perspective of a garden wall made up of angle blocks 3 to form the contour of FIG. 9*c* and the illustration of FIG. 9*b*, the bearing joints 42 of which do not extend horizontally but rather at an acute angle to the block center 31 from their external leg tips 13, in an ascending and, respectively, descending fashion. Placement in the composite arrangement with bridging of the vertical joints 26 by block centers 31 is obtained by tilting the stones of the respectively next layer by 180° and placing them first with their tips downwards into the indentations of the layer disposed therebelow, or in the subsequent layer so that their tips point upwards and they cover with their block center 31 the butt joint 26 located therebelow. The initial layer should be provided with a horizontal bearing joint 33 to improve the laying operation. The individual layers can be contrasted by color and bring about, with their upward and downward undulations as well as the projections and receding portions, a lively configurational design.

FIG. 9*b* shows the illustration II—II of FIG. 9*a* with staggered vertical joints 26 of the angle blocks 3 laid in a composite arrangement, with the mutually parallel, acute-angled bed joints 42. The upper 23 and lower 24 cross rims extend in parallel to each other at the spacing of their height 21. The cross rims 23 and 24 can, of course, also be rounded in a wavy shape.

FIG. 9*c* shows the top view I—I of the uppermost layer of FIG. 9*b* with the apex ridge edges in the block center 31.

Figure 10B:
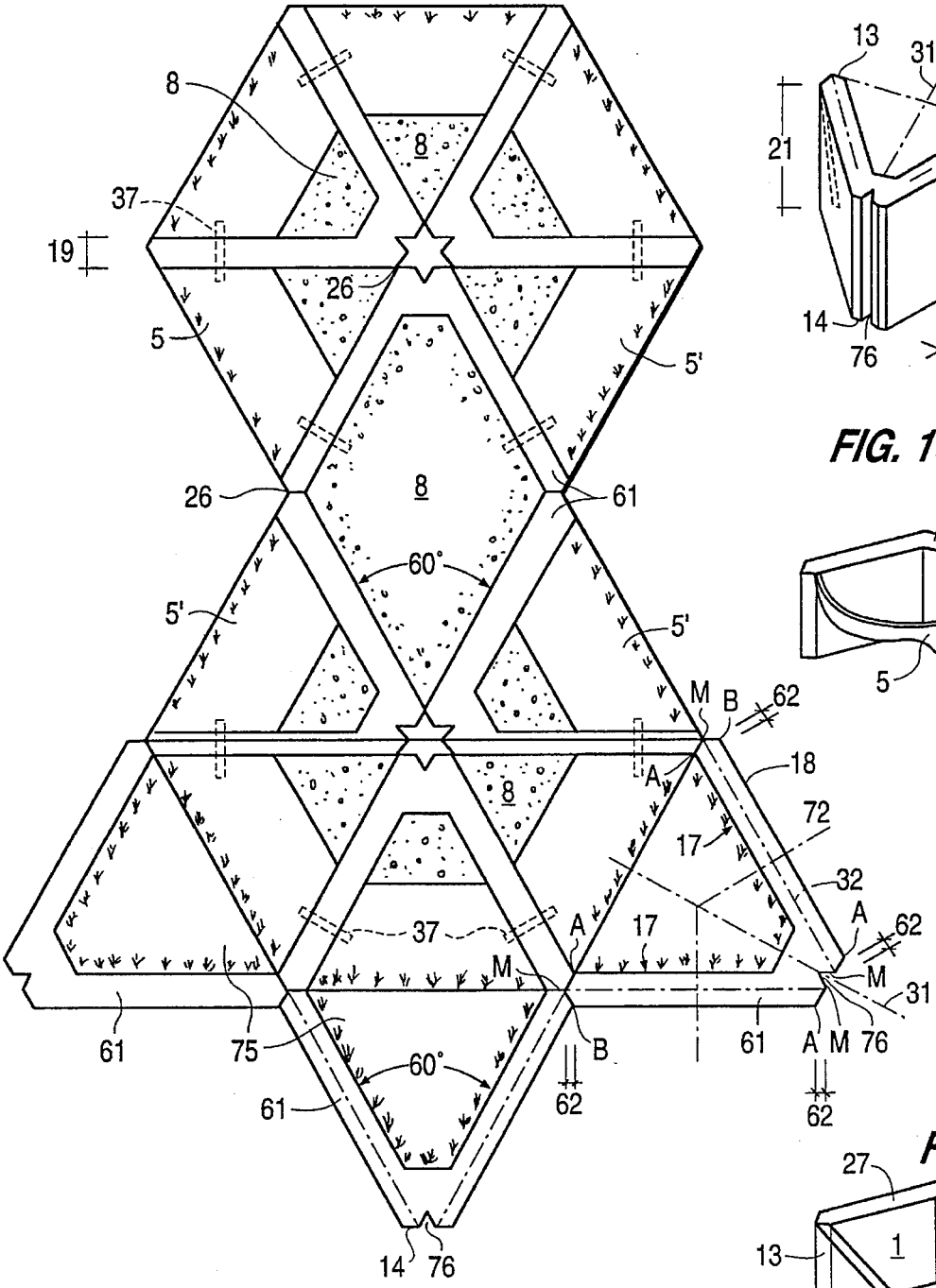
FIG. 10*b*, shows the outline of 60-degree blocks connected into two contacting hexagons, and three planting beds set in front thereof.
Figure 10A:
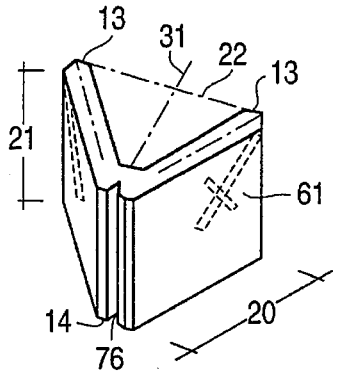
FIG. 10*a*, shows the perspective of a 60-degree block with dowel rods for retaining tier slabs 5.

FIG. 10*a* shows the perspective of a 60-degree block 61 with a leg length 20 of 45 cm, a height 21 of 25 cm, a diagonal 22 of 55 cm, and a thickness 19 of 7 cm.

FIG. 10*b* shows the outline of two hexagonal plant columns abutting in the sheet center, consisting of respectively three 60-degree blocks 61 laid in "staggered" fashion. The 60-degree interspaces and butt joints 26 between the angle,blocks 61 are bridged in the subsequent layer by the block centers 31 so that a bond is produced according to the principle of staggered vertical joints.

The open sides of the individual chambers are made by means of tier slabs 5' into planted terraces which retain the earth core 8 in the corner of the niche. The three angle blocks at the bottom of the sheet, built onto the openings, are only one layer high and serve as apron-type planting beds 75.

The leg rims 18 outside of the central leg axis 32 are symmetrical to the leg bisecting line 72 so that the projection 62 at the leg tip B–M' and the leg back A–M onto the plane of the central leg axis 32 is of the same width. The leg ridge 14 can be made with a smooth surface as well as also with a notch 76, the rims of which extend in parallel to the inner leg rims 17.

Figure 10C:
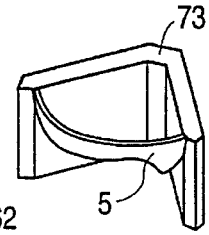
FIG. 10*c*, shows the perspective of a homogeneous angle block container 73 wherein the tier slab is connected to the angle block form.

FIG. 10*c* shows the perspective of a homogeneous angle block container 73 with which the tier plate 5 is integrally formed. The higher strength and rigidity of such a closed form as compared with the open cornerstone permits a certain saving in material. However, the form cannot be stacked one into the other.

Figure 10D:
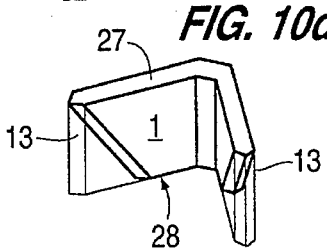
FIG. 10*d*, shows the perspective of an angle block with obliquely extending leg tips.

FIG. 10*d* shows the perspective of an angle block 1, the leg tips 13 of which extend obliquely between the upper 27 and lower 28 cross rims so that the legs of the lower cross rim 28 are shorter than at the upper cross rim 27.

Figure 11C:
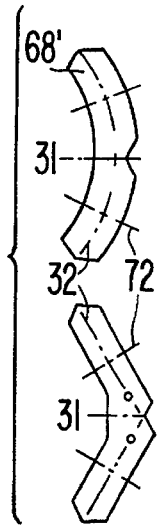
FIG. 11*c*, shows filling stones 68 in an angular shape and 68' in a round shape.
Figure 11B:
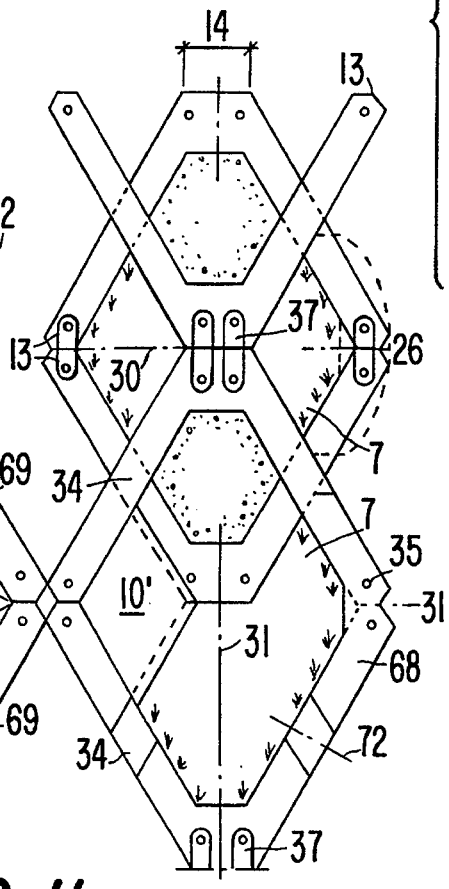
FIG. 11*b*, shows interlocking layers with grooves at the point of intersection and with a bottom slab 10.
Figure 11F:
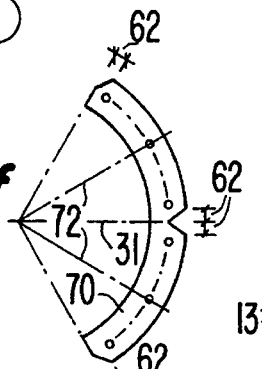
FIG. 11*f*, shows a one-third-hexagon slab 70 in rounded shape, suitable for round columns.
Figure 11D:
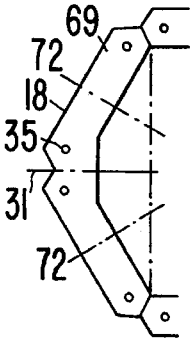
FIG. 11*d*, shows a hexagon and with three butt joints made up of three one-third of a hexagon slabs 69.
Figure 11D:
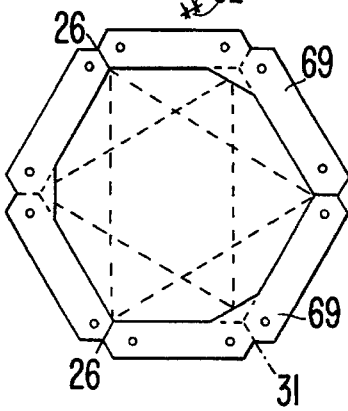
Figure 11A:
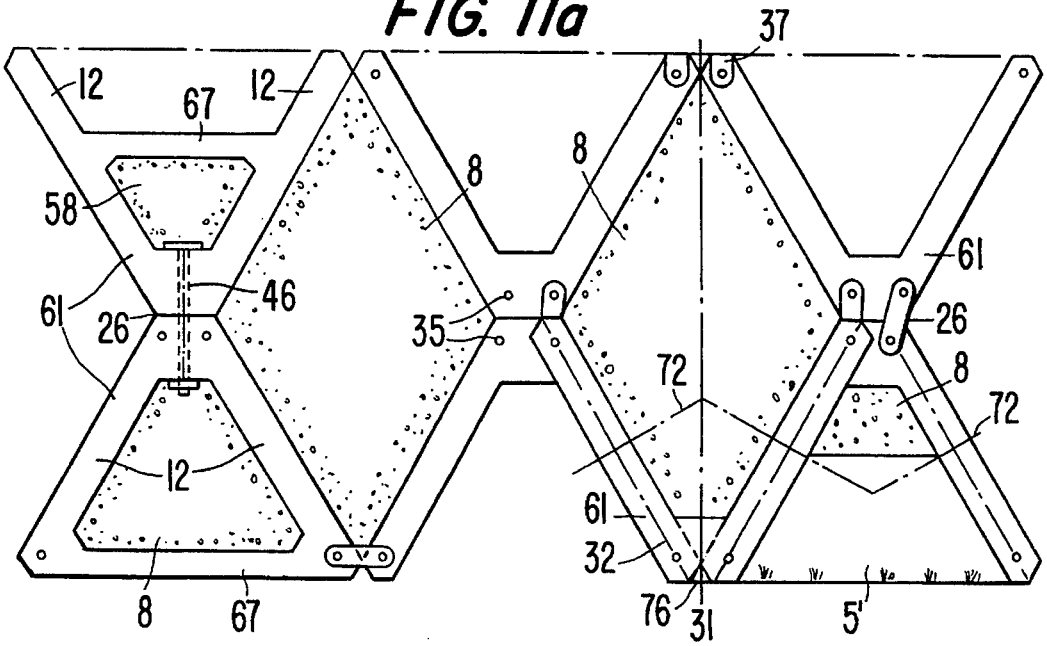
FIG. 11*a*, shows in the lowermost layer a zigzag arrangement, and thereabove a position in mirror-inverted mode.

FIG. 11*a* shows in the two lowermost rows of the sheet respectively two 60-degree angle blocks 61 joined at their backs 14 in a similar way as in FIGS. 8*a*–8*b*. In the lowermost position, an angle block 61 of the second layer is seated with its block center 31 above the vertical joint 26 located therebelow. In this way, zigzag-shaped walls can be erected, as illustrated in FIGS. 1*a*–1*f* (wall type A–l).

Tier slabs 5' partition off the right-hand lower chamber to form planting terraces. The two left-hand lower cornerstones are connected by a screw 46 and form hollow chambers between the legs with the webs 67 molded on in concrete; these chambers can be filled up to produce reinforced concrete supports.

FIG. 11*b* shows in extension of the axis 31 the intersecting angle blocks 61 which are interlocked by means of recesses 34 in the zone of their leg bisectrix 72. In contrast to the 90-degree cornerstones 1 of FIGS. 2*a*–2*d* and 3*a*–3*c*, also abutted in the longitudinal direction, the 60-degree angle blocks 61 can be abutted only with butt joints 26 in parallel to the transverse wall direction 30. By means of straps 37 and dowel rods, the butt joints 26 can be bridged at the block ridges and leg tips 13. The floor plates 10' seal the rhombic projection on one or both sides in the region of the vertical joints 26 in the downward direction, thus forming plant terraces and additionally interlocking the wall.

FIG. 11*c* shows on the right-hand edge of the sheet an angular 68 and a rounded 68' filler stone; these stones serve alternatively as a closure for the otherwise open plant terraces 7. The thus-partitioned hollow space can be grouted with concrete, for example, to form a support.

FIG. 11*d* shows a regular, equilateral hexagon wherein one layer consists of three equal-sided one-third panels 69 having an internal angle of 120° and forming an angle of 120° at the butt joint with the neighboring panel.

Each leg of the third-of-a-hexagon plate is symmetrical with its outer rims 18 with respect to the leg bisecting line 72 so that the profilings of the leg ends are of equal width and depth up to the central leg axis 32 at the tip 13 and at the leg ridge 14. In the completely constructed hexagonal support, the perpendicularly superimposed joints 26 and block ridges 31 in the illustration thus have the effect of identical sections of a perpendicularly continuously extending shadow joint.

FIG. 11*e* shows, alternatively to the one-third slab 69, a one-third hollow block 85 in the form of a pie segment in the manner of the segmental blocks 82 illustrated in FIGS. 6*g* and 6*h*, with circular cutouts in the cross plane of symmetry 31, with two semicircular cutouts on the butt joint axis 26, and with a recessed circular segment at the block tip. The widened standing surface of the hollow stone 85 as compared with the one-third slab 69 permits a faster assembly and a higher initial stability of a column built therefrom. In the same way, as a hollow stone, the one-third slab 70 can also be fashioned with a curved surface of FIG. 11*f*.

FIG. 11*f* shows the one-third slab 70 with two curved outer surfaces formed symmetrically with respect to the leg bisectrix 72. In accordance with the same principle of hexagonal columns made up of one-third slabs 69 or 85, round columns are erected from respectively three one-third panels 70 per layer with a curved outer surface, by placing, in layerwise alternation, block centers 31 onto the joints 26 located therebelow. The three one-third plates 70 form, with their curved outer face, a circular outside edge provided with six groove-like indentations, i.e. in the assembled condition with six perpendicular shadow joints.

Figure 12F:
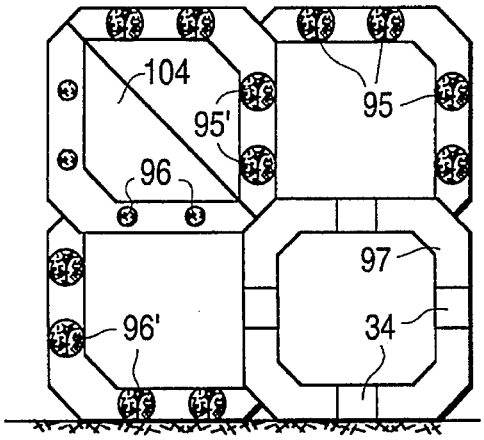
FIG. 12*a*, shows the outline of a plant tub of angle block corners and interposed slabs 99.
FIG. 12*b*, shows the outline of a rectangular hollow column of angle blocks 98 with unequal sides and/or trough blocks 102 closed on four sides.
FIG. 12*c*, shows the illustration of view 12*a* from the right-hand side.
FIG. 12*d*, shows the outline of a sheet wall corner.
FIG. 12*e*, shows the illustration of a pyramid-shaped ornamental wall with rhombic cavities.
Figure 12E:
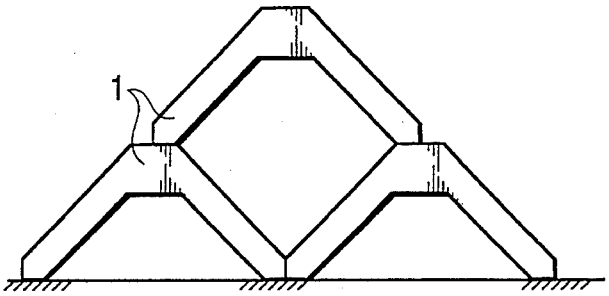
Figure 12C:
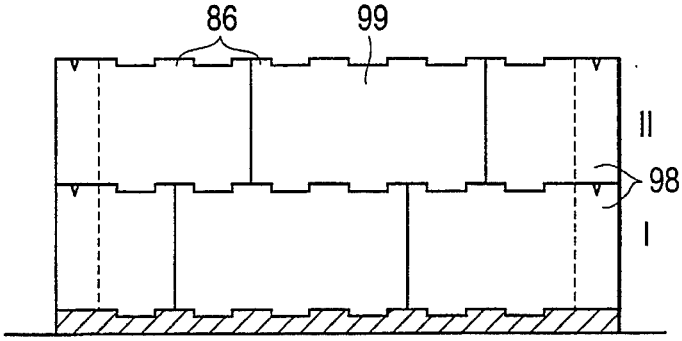
Figure 12D:
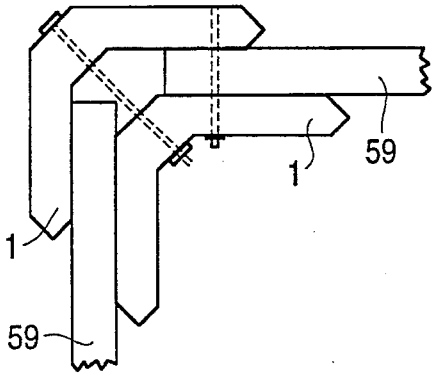
Figure 12A:
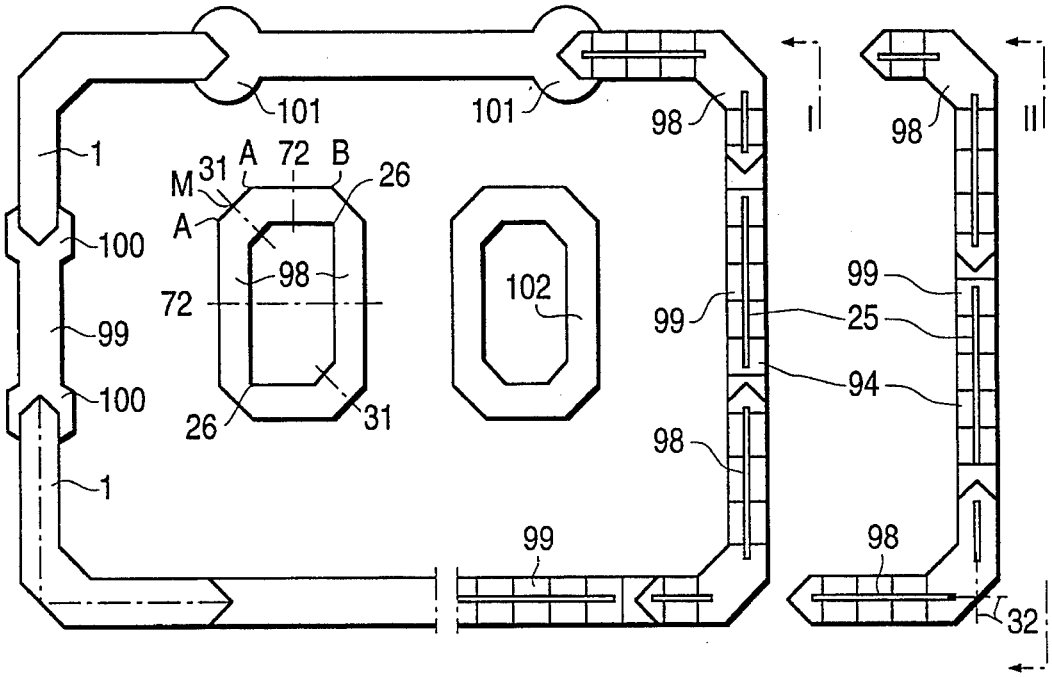

FIG. 12*a* shows the outline of a plant trough having an edge length of about 90×120 cm, the two left-hand corners of which consist of equal-sided cornerstones 1 and the two right-hand corners of which consist of unequal-sided cornerstones 98. Slabs 99 of any desired length, provided with V-type rabbets, which are shaped complementarily to the acute-angled leg ends are inserted in between the latter. In order to reinforce the material of the groove connection, thickened portions can be formed integrally with the slabs 99, these portions having an angular 100 and a round 101 cross section. The reinforcements 100 and 101 at the joint can be in the form of ornamental design elements.

The two unequal-sided angle blocks 98 form the right-hand end face of the plant trough with a short leg and a long leg, as well as with an intermediate panel 99. A second layer II covers the lower butt joints in that the angle blocks are turned and, with their long legs, cover the short legs lying therebelow, and conversely short legs come to stand on long legs.

As shown by the view of the end face in FIG. 12*c*, a composite wall of staggered vertical joints is produced in spite of the use of identical parts in both layers. The groove-shaped profilings 86 and 25 of the top and bottom edges, as shown in FIG. 5*c*, effect interlocking in the longitudinal and transverse leg directions. Also the octagonal or round profilings 95 and 96 of FIG. 12*f* provide shearproof intermeshing in the longitudinal and transverse directions between angle blocks 98 and slabs 99.

The principle illustrated in FIG. 12*a* of forming stable corners from angle blocks 1 and 98 and of interposing panels 99 joined in a shape-mating fashion can be utilized as an erection system for the construction of entire buildings. It is possible to transport, as story-high prefabricated elements, angle blocks in upright or prone position to a building site and place them at the location by means of hoisting mechanisms. Without any assembly props, otherwise necessary in case of wall panels, the angle elements are disposed unassisted and safe from tilting on their base surface.

The wall panels 99, joined to the corner elements 1 and 98 by a tongue-and-groove connection in shape-mating engagement, lean against an angle element with one side as early as in the assembly condition. After a second angle element has been connected to the second, still open panel end, the panel element 98 stands in a tip-proof fashion, clamped in place between two angle elements. The placing of cover slabs on corner and wall panels acts as a rigidifying disk and ties the wall panels in a statically effective way into a building system.

FIG. 12*b* shows on the left-hand side the outline of a rectangular column, composable from two identical, unequal-sided angle blocks 98, the vertical joints 26 of which are bridged, in the subsequent layer, by the block ridges 31 of two identical blocks 98 by turning the latter "upside down". The remaining description corresponds to the square column presented in FIG. 6*a*.

On the right-hand side, the same outline is formed, beside the first outline, by a single rectangular trough block 102, closed on four sides, this block being combinable with the same trough blocks 102 or with rectangular cornerstones 98, for example into columns in any desired way.

FIG. 12*c* shows the illustration of the two layers I—I and II—II shown in contour in FIG. 12*a*, pertaining to the right-hand end face of the plant trough. The lateral parts of the plant trough can either be placed on the ground or on corresponding floor plates and, with complementary joint profiling, can be connected to these plates in a shape-mating way.

FIG. 12*d* shows the contour of a sheet wall corner consisting of two cornerstones 1 set side-by-side at a spacing, these stones being stackable in height, with interposed sheet panels, such as, for example, crossties and the like.

With the aid of screws passed through horizontally, the cornerstones can be threaded together at the legs or the block ridges, and the interposed sheet panels can be clamped therebetween. The more intimate the bond of the two angle blocks, the more rigid, tilt-proof, and thus more load-bearing and the higher can the corner be designed. The insertable sheet panels 59 and thus the spacings between the corner elements can be of a corresponding length.

FIG. 12*e* shows the illustration of a square ornamental wall composed of 6 angle blocks 1 with a total of 2×2=4 interiorly located squares. By adding another 6 angle blocks 1, an ornamental wall of 3×3=9 interiorly located squares can be erected, and so forth. The joints are glued and/or additionally doweled. The right-hand lower square 97 can be produced alternatively and in the contours congruent to two contacting angle blocks 1 as a closed trough stone 97 which, as an irregular octagon, is equipped with respectively one cutout 34 on the bisectrices of the longitudinal sides.

The angle blocks lying thereabove are provided with respectively two octagonal, button-shaped elevations 95 and indentations 95' per leg cross rim; these are fashioned to complement each other.

Analogously, the two left angle blocks are illustrated with round profilings 96 and depressions 96' of their cross rims. The round as well as the octagonal "button profiles" permit a doweling of the horizontal joints that is shear-proof in the longitudinal and transverse directions.

The left upper square, formed from two angle blocks 1, shows a diagonal joint of two cover panels 104 connected with the angle blocks. The button-like elevations of the angle blocks 95' and 96' engage in a shape-mating fashion into the complementary recesses of the cover panels.

FIG. 12*f* shows the illustration of a pyramid formed from three cornerstones 1 standing on their bases. In this arrangement, respectively one cornerstone stands with "spread-apart legs" on the "backs" of two cornerstones located therebelow and being in contact at the "feet". In case the base is appropriately broadened, the pyramid can be built up to up to 10 layers and can be made into ornamental walls and sculptures. The joints are glued and/or doweled.

I claim:

1. A structural set of angle elements fitting into one another, for the erection of freestanding planted walls and columns, visual protection and acoustic protection walls, escarpment stabilizations to be filled on one side, real estate, path, and flower bed surrounds, prefabricated buildings, for pieces of furniture, room dividers, and building models, predominantly of concrete, but also of other materials, including polyester concrete, ceramic, synthetic resin, wood, and metal, said angle elements each having two free legs designed symmetrically to a transverse plane of symmetry of the angle element as seen in a top view thereof, which legs of each angle element are joined together by way of a leg ridge, said two legs of each angle element extending at an internal angle of between 60° and 90° with respect to each other on an inner side of said element and each leg having equal-sided leg tips at an outer free end thereof as seen in said top view, wherein leg rims are defined by an outer side of each leg and a portion of said leg ridge on respective sides of said transverse plane of symmetry of each angle element, which leg rims are each formed symmetrically with respect to a respectively associated leg bisectrix bisecting the leg in a direction transverse to the longitudinal extent of the leg as seen in said top view, and the projections of the leg tip and said portion of the leg ridge of said outer rims onto the plane of the associated leg axis of symmetry are of the same length, wherein the boundary surfaces of the legs extending on both sides of the axis of symmetry of the legs are fashioned as planar surfaces extending in parallel to each other, and wherein inner and outer boundary surfaces of said leg ridge as seen in said top view are parallel to one another, the length of said inner boundary surface being greater than half that of said outer boundary surface and the thickness of said leg ridge being greater than a thickness of said legs, and said structural set of angle elements further including tier slabs, attached to the angle elements and having outer rims converging in an acute angle to each other defining an angle smaller by 10° to 30° than said internal angle of the angle elements, the tier slabs, with an inclined positioning, being placed into shape-mating engagement with the legs thereof and being retained in a stable position by being supported at two bearing points.

2. A structural set according to claim 1, wherein said leg tips are right-angled, equal-sided with a side length as seen in said top view corresponding to half the length of the outer boundary surface of the leg ridge, and wherein the outer boundary surface of said leg ridge and the inner rims of the leg tips are parallel to one another.

3. A structural set according to claim 1, wherein at upper and lower cross-sectional surfaces of the angle elements and tier slabs at least two dowel holes per leg are recessed along their leg axis of symmetry and symmetrically to said leg bisectrix thereof, wherein the dowel holes are fashioned as penetrating hollow tubes extending between the transverse rim surfaces and can be brought into shape-mating engagement with each other by complementarily designed centering dowel rods.

4. A structural set according to claim 1, wherein the two free legs of the angle elements or, respectively, their inner rims are joined by webs and braces of material and are designed as laterally closed hollow blocks, wherein the rims of the braces are fashioned to be symmetrical to said transverse plane of symmetry thereof.

5. A structural set according to claim 1, wherein the internal angle defined by the leg rims and that of the leg tips amounts to ninety degrees.

* * * * *